US006776135B1

(12) United States Patent
Chen et al.

(10) Patent No.: US 6,776,135 B1
(45) Date of Patent: Aug. 17, 2004

(54) ROTARY ENGINE

(76) Inventors: Tsung-Yun Chen, 2F., No. 18, Lane 147, Fu-Hwa Road, Taipei (TW); Yun-Wu Cheng, 1976 Waycross Rd., Fremont, CA (US) 94539; Yao-Chi Chen, 1976 Waycross Rd., Fremont, CA (US) 94539

( * ) Notice: Subject to any disclaimer, the term of this patent is extended or adjusted under 35 U.S.C. 154(b) by 0 days.

(21) Appl. No.: 10/657,123

(22) Filed: Sep. 9, 2003

(30) Foreign Application Priority Data

Mar. 3, 2003 (TW) ..... 92104367 A

(51) Int. Cl.[7] ..... F02B 57/00; F02B 53/00

(52) U.S. Cl. ..... 123/241; 123/43 R; 91/491

(58) Field of Search ..... 123/241, 43 R; 91/491, 339

(56) References Cited

U.S. PATENT DOCUMENTS

| | | | | |
|---|---|---|---|---|
| 1,400,255 | A | * 12/1921 | Anderson | 123/241 |
| 3,373,723 | A | * 3/1968 | Blosser | 123/241 |
| 3,438,358 | A | * 4/1969 | Porsch et al. | 123/241 |
| 3,923,013 | A | * 12/1975 | Myers | 123/241 |
| 4,072,132 | A | * 2/1978 | Lindros | 123/241 |
| 6,457,450 | B1 | * 10/2002 | Luzhkov | 123/241 |
| 6,668,767 | B1 | * 12/2003 | Sanchez Talero et al. | 123/241 |

FOREIGN PATENT DOCUMENTS

| | | | | |
|---|---|---|---|---|
| CA | 1155064 | A * | 10/1983 | 123/43 R |
| DE | 1 576 044 | * | 7/1970 | 123/241 |
| DE | 1 954 069 | * | 4/1971 | 123/241 |
| DE | 42 25 932 | A1 * | 2/1994 | 123/241 |
| EP | 103985 | A2 * | 3/1984 | 123/241 |
| FR | 1 255 205 | * | 1/1961 | 123/241 |
| FR | 2 651 828 11 | * | 3/1991 | 123/43 R |
| FR | 2 744 172 | A1 * | 8/1997 | F02B/57/00 |

* cited by examiner

*Primary Examiner*—Thomas Denion
*Assistant Examiner*—Thai-Ba Trieu
(74) *Attorney, Agent, or Firm*—Birch, Stewart, Kolasch & Birch, LLP

(57) ABSTRACT

The present invention provides a rotary engine having: a stationary cylinder with an intake aperture, an exhaust aperture, and an ignition aperture on the surface; a driving disk disposed inside the stationary cylinder connected to an external driving source through a shaft, the driving disk being secured to a surface of at least one rotational cylinder that are together driven by the driving source; and a swing piston installed inside the rotational cylinder driven by a driving member to move within the rotational cylinder to alter the intake and exhaust volume of the rotational cylinder. The intake and exhaust volume changes corresponding to the position of the rotational cylinder which follows the intake, ignition, and exhaust sequential process to complete the intake, compression, combustion, and exhaust cycle of an engine to create a simple yet high output, low-friction engine with superior cooling.

29 Claims, 29 Drawing Sheets

ROTARY ENGINE

This nonprovisional application claims priority under 35 U.S.C. §119 (a) on patent application No. 092104367 filed in TAIWAN, R.O.C. on Mar. 3, 2003, which is (are) herein incorporated by reference.

FIELD OF THE INVENTION

The present invention generally relates to a rotary engine and, more particularly, to a rotary engine that improves output efficiency, reduces friction wear, and decreases fuel consumption, and at the same time is easy to manufacture and has the flexibility to increase the number of cylinders to improve the performance of the rotary engine.

DESCRIPTION OF RELATED ART

FIG. 23 shows a conventional reciprocating engine 100 that uses a confined space for sequentially performing the four cycles of intake, compression, combustion, and exhaust, where the crank 110 inside the engine 100 generates the rotational output. The theory behind the traditional engine 100 has been widely applied in our daily lives for all kinds of land, sea, and air transportation, as well as power generating apparatus for agricultural, manufacturing, and military use. Even though the reciprocating engine is broadly accepted and used, it does not mean that the performance has reached perfection. In fact, there are the following bottlenecks in the reciprocating engine 100 regardless whether it is of 2-stroke or 4-stroke design:

(1) Output power cannot be easily increased: reciprocating engine 100 relies on a crank 110 to convert the reciprocating motion of the piston 120 into a rotational motion which is then coupled to an external driving system. The conversion from the reciprocating motion into the rotational motion causes a loss in the output efficiency, which is unavoidable due to structural limitations.

(2) Structure and manufacturing are complex: the output efficiency of the reciprocating engine 100 is highly related to the precision in the manufacture of the crank 110, wherein the precision of the crankshaft 112 and the crank pin 115 needs to be extremely high. If there is any error in the level of precision, the conversion from reciprocating output to rotational output will be greatly decreased. Moreover, in a four-cylinder reciprocating engine, the internal parts add up to forty linked parts for operation which results in a high manufacturing cost.

(3) Torque-increase causes fuel consumption to increase: a reciprocating engine 100 can increase the stroke, that is to increase the distance between the connecting rod 117 and the crank 110, to rise torque. If the stroke is increased, the bore of the cylinder 125 also needs to be increased; therefore, fuel consumption is greatly increased, so an increase in torque and a decrease in fuel consumption cannot be achieved simultaneously.

(4) Increase of the number of cylinders is limited: if the number of cylinders is increased to raise the horsepower of the reciprocating engine 100, the engine overall size is unavoidably increased. Regardless of the configuration of the cylinders, such as straight, boxer, and slant or the type of configuration V, W, and H, the engine size always increases significantly when cylinders are added.

(5) high-rpm causes wear: when the reciprocating engine 100 revolves over 2000 rpm, such high-rpm reciprocating action will cause the piston 120 to experience an extremely high amount of wear, which, at the same time generates a lot of heat, increasing damage to parts and decreasing the lifespan of the engine. As a result, fuel consumption of the engine increases over time.

In order to solve problem (1) of reciprocating engine 100 regarding power output, a German engineer Felix Wankel invented the Wankel rotary engine 150, which is illustrated in FIG. 24. An arciform triangular rotor 160 is held within a rotor holding bore 165, which replaces the cylinder 125 and the piston 120 of the reciprocating engine 100. The conformance to a peri-trochoidal profile is driven by the requirement that all three bearing points of the Wankel rotor remain in constant contact with the inner surface of the engine. The rotor rotates in a planetary motion through the engaging of a rotor gear on the rotor with a gear on an output shaft. The interplay of the arciform triangular rotor within the rotor holding bore creates three chambers therein. Under planetary motion of the rotor, the chambers outside of the rotor vary their capacities to perform the four cycles of intake (suction), compression, combustion (expansion), and exhaust. The output of the Wankel engine 150 is directly connected to the arciform triangular rotor 160 without the need of motion type conversion. The output of the Wankel engine 150 is twice that of the reciprocating engine 100, and the overall number of components of the Wankel engine 150 is greatly reduced; therefore, from the market launch in 1958, it caused a great shock in the industry. In the era of the 60s, when power was most sought after, the high output rotary engine was put on sports cars, breaking speed records for sports cars, and the rotary engine seemed poised to take over the traditional reciprocating engine 100.

Although the Wankel engine 150 improved problem (1) of the reciprocating engine 100, it failed to successfully solve problems (2), (3), and (4). Furthermore, the path of the arciform triangular rotor 160 is not smooth, so at high-rpm, wear at the tips of the rotor 160 causes the exhaust cavity immediately following the ignition point to rapidly enlarge. This causes a significant portion of the gas pressure to be lost to expansion within the enlarging cavity, instead of being converted into useable torque. The problem of power decreasing and fuel consumption increasing becomes more significant as the engine runs more, and, for about every 30,000 miles, the engine needs rebuilding or replacement. This disadvantage proved fatal for the the Wankel engine 150, resulting in the higher carbon monoxide exhaust levels and fuel consumption. The architecture of the Wankel engine, i.e., a peri-trochoidal section, makes it difficult to improve the combustibility of the combustion phase to decrease the exhaust quantity of unburned gases. Although the number of parts of the Wankel engine 150 is much less than a conventional engine, the precision of the inner gear 180 and the outer gear 185 of the arciform triangular rotor 160 has to be extremely high, offsetting the cost-savings generally associated with having fewer parts. Furthermore, the arciform triangular rotor 160 is the part that undergoes the most wear in the engine, and, if there is a problem on a Wankel engine 150, the whole unit is usually replaced, which reduces practicality. The Wankel engine 150 overcomes some of the limitations of the reciprocating engine 100, but possesses other disadvantages not found in generic reciprocating engines; therefore, market acceptance has not been as rapid as expected.

Beginning with the energy shortage of 1973, vehicle engine research has shifted focus from increasing power to the twin goals of decreasing exhaust emissions and fuel consumption. The shortcomings of the Wankel engine rapidly became apparent and most of the car manufacturers cancelled development of the Wankel engine and returned to designs employing the reciprocating engines. Among all the car manufacturers, only Mazda continued the use of Wankel engine and kept making performance modifications. Mazda launched the RX7 model in 1999 with the use of modern lubricants and ceramic material for the triangular tips to lower the wearing problem of the Wankel engine. However, the use of this material greatly increases the manufacturing cost.

Any novel industrial product must possess advantages and performance that are not found in prior art. Moreover, the setup of the production equipment and production line cannot be too expensive compared to prior art, otherwise existing manufacturers will not the existing product line and business prospects. Possession solely of technical performance is generally not enough for a new design to change the percentage of market share away from conventional technology. Performance has to be combined with ease of manufacturing and low cost to attract manufacturers to invest in or replace production lines.

On inspection of the history of the Wankel engine, it can be seen that the difficulty of manufacturing the arciform triangular rotor and the requirement for entirely new equipment to manufacture such a rotary engine caused the Wankel engine to fail to attract manufacturers.

Summarizing the above, new designs tend to introduce new problems; therefore, advantages must significantly outweigh disadvantages in order for the new design to take hold. The focus of current engine research is how to design a simple and low cost engine which has higher output than the conventional reciprocating engine while at the same time lowers wear and fuel consumption, increases torque without the expense of fuel consumption, and does not increase engine size significantly with the addition of cylinders.

SUMMARY OF THE INVENTION

An objective of the present invention is to provide a high output rotary engine.

Another objective of the present invention is to provide a rotary engine that is simple yet low-cost to manufacture.

Another objective of the present invention is to provide a rotary engine that does not increase fuel consumption while increasing the torque of the rotary engine.

Another objective of the present invention is to provide a rotary engine that does not increase engine size while increasing the number of cylinders of the rotary engine.

Another objective of the present invention is to provide a rotary engine that minimizes wear while rotating.

Another objective of the present invention is to provide a rotary engine that decreases fuel consumption.

Another objective of the present invention is to provide a rotary engine that provides good lubrication without requiring additional lubrication equipment.

Another objective of the present invention is to provide a rotary engine that is efficiently air-cooled.

Another objective of the present invention is to provide a rotary engine that has smooth rotation over a long lifespan.

In achieving the above and other objectives, the rotary engine of the present invention comprises: a stationary cylinder wherein the surface has an intake aperture, exhaust aperture, and ignition aperture (for providing combustion); a cover plate having an elliptical track which is coupled to the stationary cylinder to form a first cavity; a driving disk that is mounted on a first shaft in the middle of the stationary cylinder by method of insertion, such that driving disk is accommodated inside the first cavity, and, at the same time, the first shaft protrudes out of the stationary cylinder for coupling to a driving source which provides drive for the driving disk; and, at least a rotational cylinder having a second cavity therein placed on the surface of the driving disk and driven by the driving disk that is mounted to the first shaft within the first cavity. The surface of the rotational cylinder comprises a window interacting with the intake aperture, the exhaust aperture, and the ignition aperture during rotation of the rotational cylinder. The intake aperture, the exhaust aperture, and the ignition aperture perform both the intake/exhaust process and the combustion process between the second cavity and the outside through the intake/exhaust window while the two rotational cylinders are rotating; at least one swing piston corresponding to the rotational cylinder is secured on a second shaft by method of insertion. The swing piston is placed in the second cavity of the rotational cylinder. The second shaft makes a slight rotation that allows the swing piston to swing within the second cavity to render the second cavity as a volume-variable intake/exhaust space; at least one driving member that corresponds to the rotational cylinder couples to the corresponding second shaft and is used to drive the second shaft to rotate within the second cavity, wherein the swing piston swings to alter the volume of the intake/exhaust space. The alteration of the intake/exhaust volume completes the intake, compression, combustion, and exhaust process of this rotary engine design when the rotational cylinder rotates according to the intake, exhaust and ignition sequence.

The aforementioned driving member is a driving wheel assembly comprising a mutually coupled driven wheel set and a leading wheel set, wherein the driven wheel set is coupled to the second shaft that extends out of the driving disk. The driven wheel set is driven by the driving disk to concentrically rotate about the first shaft and the leading wheel set rotates in an elliptical track on the surface of the cover plate. The interconnected rotation between the leading wheel set and the driven wheel set creates a drag that causes the second shaft that is secured by the driven wheel set to rotate slightly and causes the swing piston to swing. The swing piston causes the volume of the intake/exhaust space of the rotational cylinder to gradually increase before the intake operation, to gradually decrease before the ignition operation, to gradually increase again before the exhaust operation, and then gradually decrease to exhaust all gas. This cycle completes the intake, compression, combustion, and exhaust sequence. Furthermore, the rotational cylinder and outer wall of the swing piston are provided with a plurality of seal guides to prevent the rotational cylinder from leaking air through the gap between the rotational cylinder and the swing piston during the intake/exhaust operation.

The rotary engine of the present invention is further coupled to a lubrication oil tank for pumping lubricating oil to flow on the surface of the trenches which exist on the first shaft. During rotation of the first shaft, centrifugal force will automatically spray the lubricating oil onto the surface of the stationary cylinder to cool and lubricate the internal parts of the rotary engine.

In summary, the driving disk, the rotational cylinder, the swing piston, and the driving system of the present invention can solve most of the problems experienced by rotary engines in the prior art. Besides improving the output efficiency of the rotary engine, the number of parts is reduced and the complexity of manufacturing and structure is reduced. A special feature of the present invention is the use of a stationary cylinder and rotational cylinder. This special feature allows flexibly increasing the number of cylinders to increase horsepower without increasing the size of engine or sacrificing fuel consumption. Furthermore, the driving disk and rotational cylinder combination and the design of the leading wheel set of the driving system of the present invention provides smooth operation and low wear at high rpm, which increases the lifespan of the engine and also reduces fuel consumption. The design of the seal guides and lubricating oil device provides the present invention with sealing, cooling, and lubricating.

DESCRIPTION OF THE PREFERRED EMBODIMENT

Figure 1A:
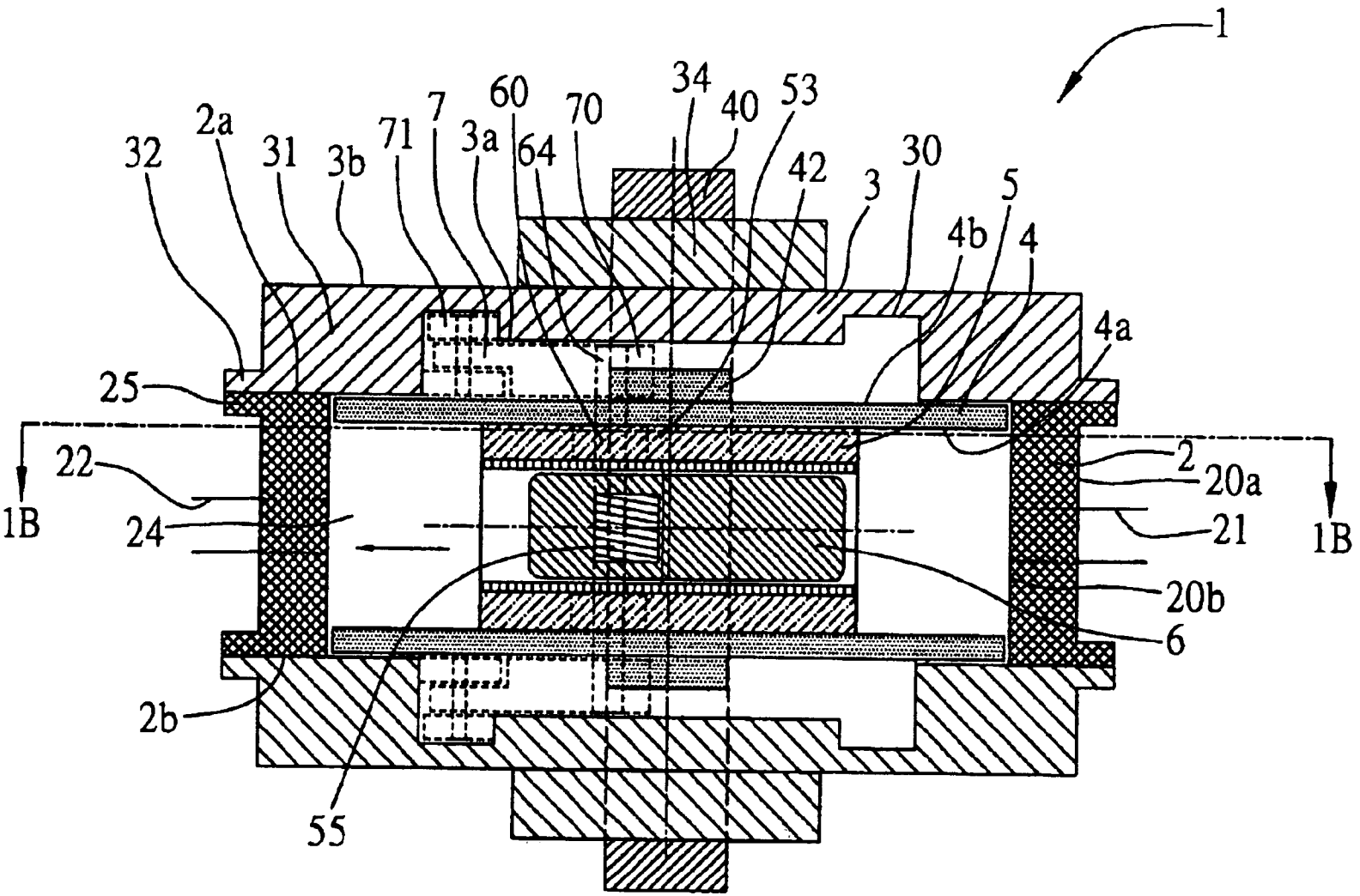
FIGS. 1A and 1B are schematic diagrams of the twin-cylinder rotary engine according to the first embodiment of the present invention.
Figure 1B:
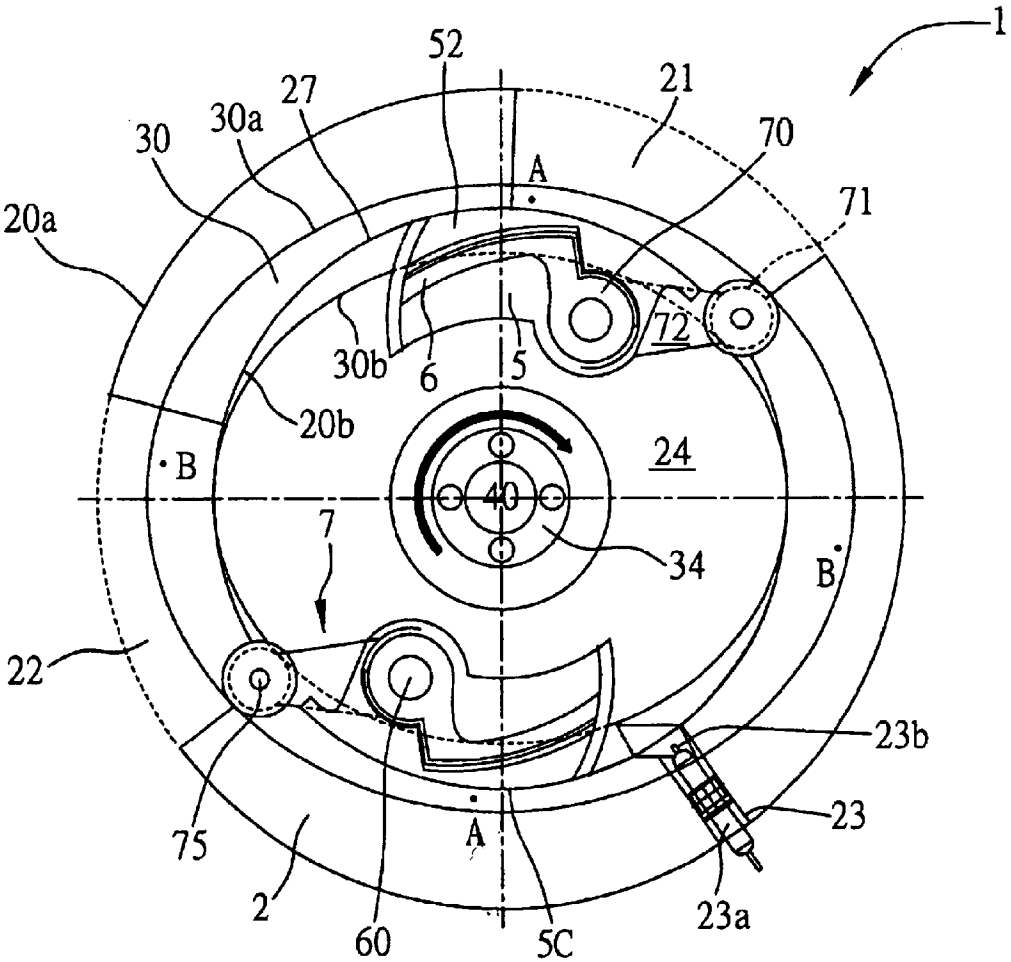

The first embodiment of the rotary engine 1 of the present invention is provided with two cylinders and is shown in FIGS. 1A and 1B, wherein FIG. 1A shows the side-view of the rotary engine 1 and FIG. 1B shows the diagram of FIG. 1A along the cut line 1B—1B. The internal parts as shown in the diagrams comprise: a circular stationary cylinder 2 further comprising opposite top and bottom opening (FIGS. 2A and 2B), wherein the outer wall 20*a* of the stationary cylinder 2 provides the stationary cylinder 2 with an intake aperture 21, an exhaust aperture 22, and an ignition aperture 23 (for introducing a spark plug 23*a* to initiate combustion); two layer cover plates 3 (FIG. 5), wherein the surface 3*a* of the cover plate 3 is formed with an elliptic track 30, and the surface 3*a* with the elliptical track 30 faces the opening of the circular stationary cylinder 2 to create a first cavity 24 by coupling to the stationary cylinder 2; two driving disks 4 (FIG. 3) secured at the top and bottom ends of the first shaft 40, the first shaft 40 being inserted in the stationary cylinder 2 driving the two driving disks 4 within the first cavity 24 and being partially exposed outside the stationary cylinder 2 to couple to a motor (not shown) which provides the driving source to the two driving disks 4; two rotational cylinders 5 (FIGS. 1B, 6A, and 6B) fastened and sandwiched between the two driving disks 4, which rotate in the first cavity 24 about the first shaft 40 performing a rotation in a circular orbit 27, a second cavity 52 being placed inside the rotational cylinders 5, wherein an intake/exhaust window 50 is formed on the peripheral arc surface 5*c* of the two rotational cylinders 5, the intake aperture 21, the exhaust aperture 22, and the ignition aperture 23 to perform both the intake/exhaust process and the combustion process between the second cavity 52 and the outside through the intake/exhaust window 50 while the two rotational cylinders 5 are rotating; two swing pistons 6 (FIGS. 1B, 9A, and 9B) that correspond to the two rotational cylinders 5 are secured on the second shaft 60 inserted into the corresponding rotational cylinders 5 and placed inside the corresponding second cavity 52, wherein the slight rotation of the second shaft 60 causes the swing pistons 6 to swing in the second cavity 52 to alter the volume of the intake/exhaust space; and four driving wheel assemblies 7 (FIGS. 1B, 11A, and 11B), wherein two form a pair and each pair is respectively placed at the top and bottom of the stationary cylinder 2 between surfaces of the cover plate 3 and the driving disk 4, the driving wheel assemblies 7 coupling to the second shaft 60 in which the second shaft 60 exposes out of the driving disks 4 and driving the second shaft 60 to rotate slightly within the second cavity 52 further swinging the swing piston 6 to change the volume of the intake/exhaust space, the rotation of rotational cylinder 5 changing the volume of the intake/exhaust space according to the rotational process of the intake aperture 21, the ignition aperture 23, and the exhaust aperture 22 to comply with the location difference of the intake aperture 21, the ignition aperture 23, and the exhaust aperture 22 to complete the steps of intake, compression, combustion, and exhaust.

Figure 2A:
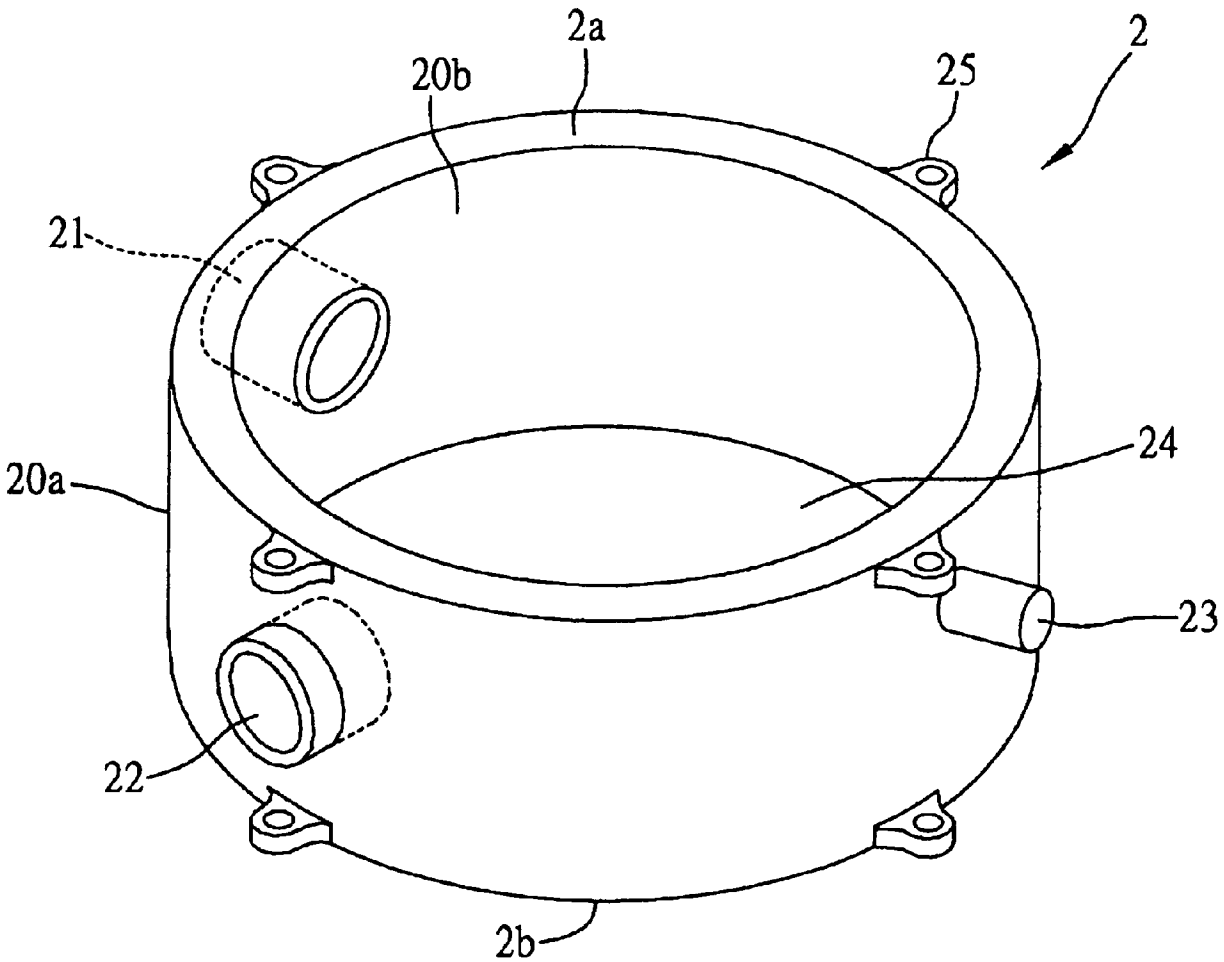
FIGS. 2A and 2B are schematic diagrams of the stationary cylinder of the twin-cylinder rotary engine according to the first embodiment of the present invention.
Figure 2B:
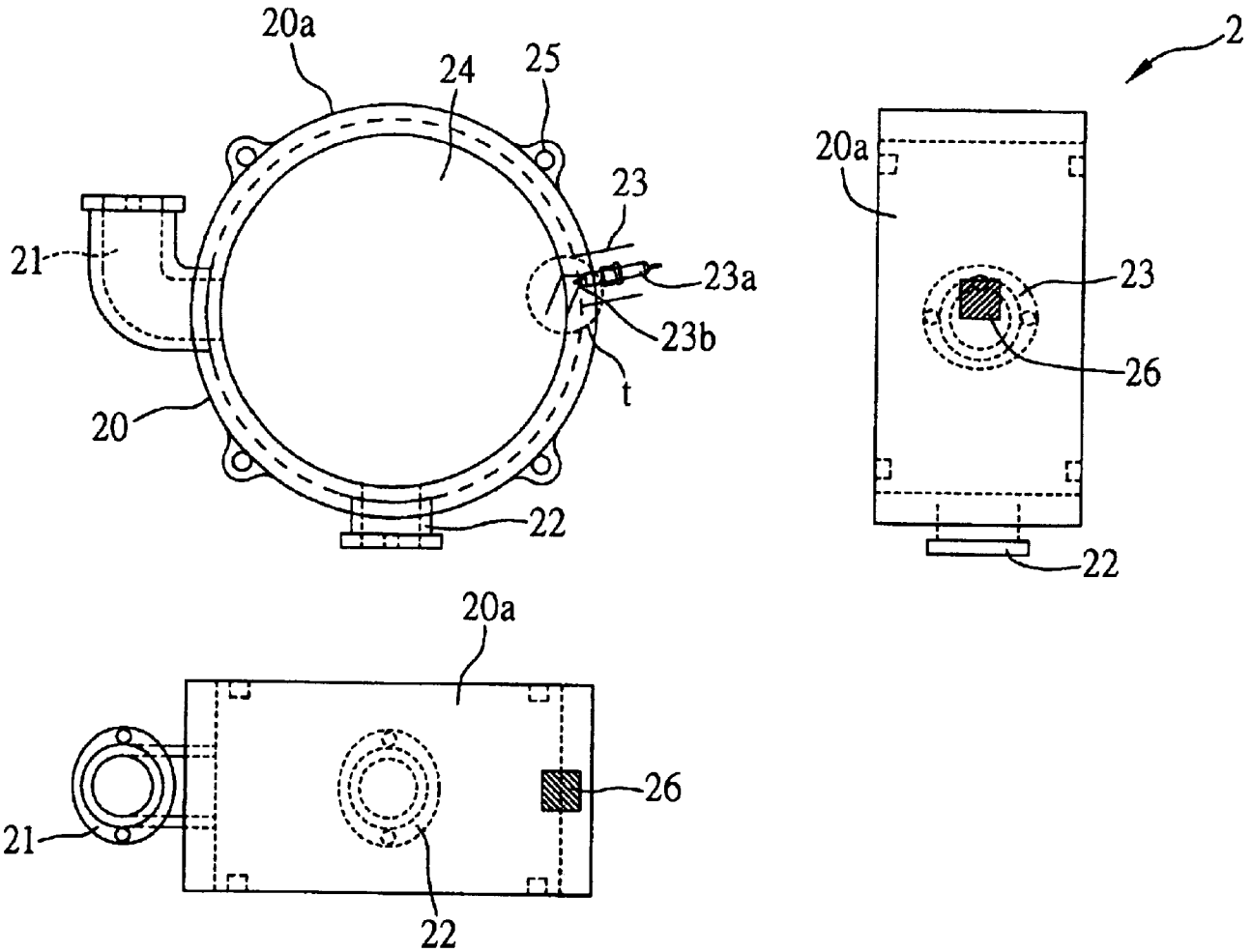

The stationary cylinder 2, shown in FIGS. 2A and 2B, is in the shape of a cylinder with openings on the top and bottom surfaces 2*a* and 2*b*. The outer and inner diameter of the cylinder is dependent on the operation and the number of rotational cylinders 5 of the predefined internal parts of the rotary engine 1, wherein four screw mounts 25 are placed on the periphery of the top and bottom surface 2*a* and 2*b* and are formed integrally with the cylinder. The screw mounts 25 allow the cover plate 3 to be secured to the stationary cylinder by the top and bottom surfaces of 2*a* and 2*b*. The outer wall 20*a* of the stationary cylinder 2 forms the first cavity 24, which is hermetically sealed by the top and bottom two-layer cover plates 3.

According to FIG. 2B, the outer wall 20*a* of the stationary cylinder 2 has an intake aperture 21, an exhaust aperture 22, and an ignition aperture 23 which can accommodate a spark plug 23*a* for initiating combustion, for performing the intake, exhaust, and ignition steps, wherein the sequence of the location is dependent on the design of the rotational direction of the first shaft 40. The rotational cylinder 5 is driven by the first shaft 40 to follow the sequence of intake aperture 21, ignition aperture 23, and exhaust aperture 22 to complete the basic process of intake, compression, combustion, and exhaust. At the same time, in the design of the present invention, the opening direction t is that the ignition aperture 23 faces the first cavity 24 of the stationary cylinder 2, as illustrated in the direction of the tangent line of the stationary cylinder 2. This special characteristic allows the full delivery of the output power in combustion to the first shaft 40. After the spark plug 23*a* in the ignition aperture 23 ignites combustion, there is no energy loss due to the difference in transmission style and direction of the drive source (as is exhibited in a reciprocating engine of the prior art). The closer the inner-facing opening of the ignition aperture 23 is to the tangent line of the stationary cylinder 2, the more output efficiency the rotary engine 1 generates. The spark plug 23*a* of the ignition aperture 23 can be fitted with an injector 23*b* that faces downward a little bit in order to prevent the lubricating oil 82 sprayed from the lubrication device 8 (described in details later) from naturally flowing downwards to block the injector 23*b* of the spark plug 23*a*. At the same time, the ignition aperture 23 further comprises a combustion chamber 26 for performing the ignition operation while the rotational cylinder 5 rotates past the ignition aperture 23.

Furthermore, the location of the intake aperture 21, the exhaust aperture 22, and the ignition aperture 23 is dependent on the location of the rotational cylinder 5. They are usually located at half the height of the outer wall 20*a* of the stationary cylinder 2 and they are usually ⅓ the perimeter distance apart (as in FIG. 2B) on the outer wall 20*a* which allows the airflow to flow uniformly during the intake/exhaust process. The movable swing piston 6 allows the airflow into the rotational cylinder 5 to have enough compression time. However, the distance in between any two of the three apertures is not constant. If the designer wishes to increase the compression time from the swing piston 6, one can place the intake aperture 21 and the exhaust aperture 22 closer on the outer wall 20*a* to increase the distance to the ignition aperture 23. And this will make the compression and exhaust operation inside the rotational cylinder longer. Furthermore, the diameter and openings of the three apertures are not limited to what is described in the preferred embodiment. However, the intake aperture 21 and the exhaust aperture 22 should be big enough to provide adequate intake/exhaust volume to achieve high intake/exhaust efficiency.

Figure 3:
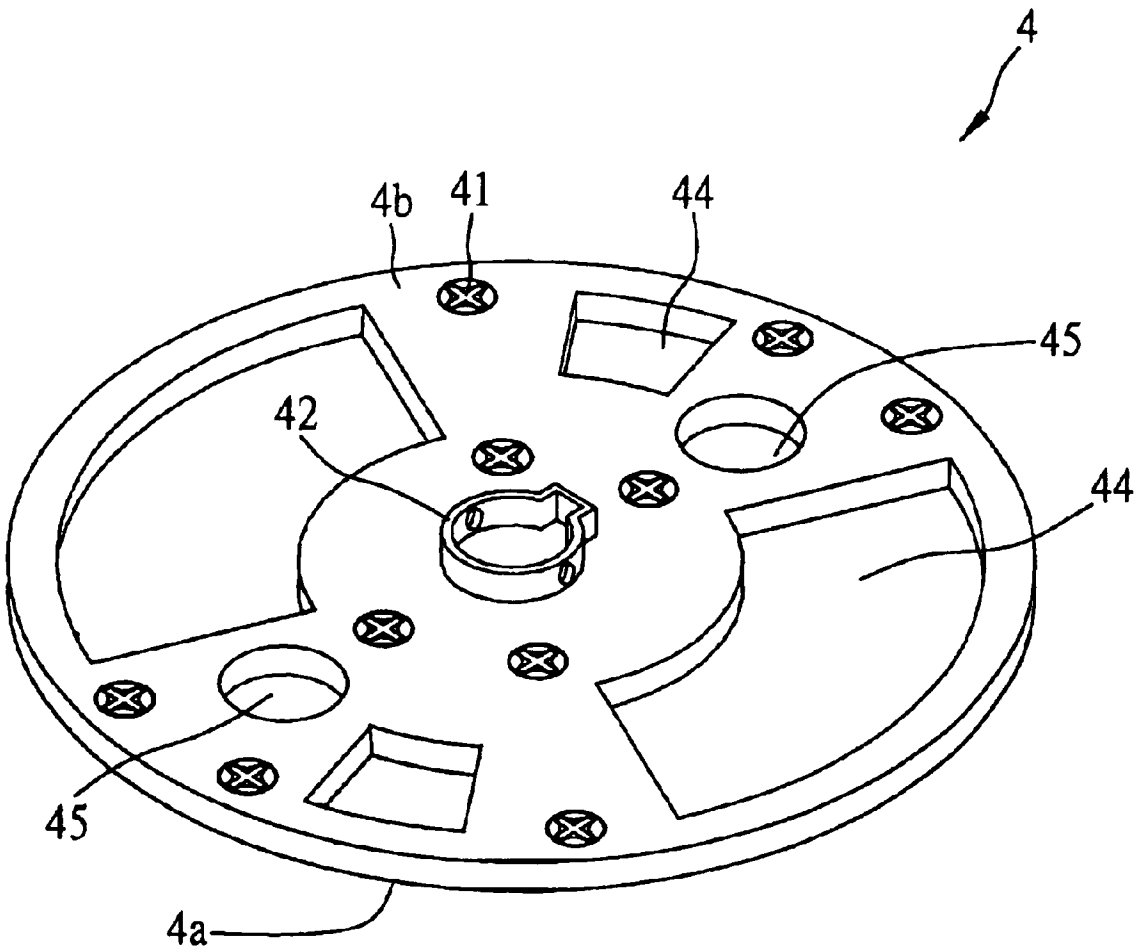
FIG. 3 is a schematic diagram of the driving disk of the twin-cylinder rotary engine according to the first embodiment of the present invention.
Figure 4:
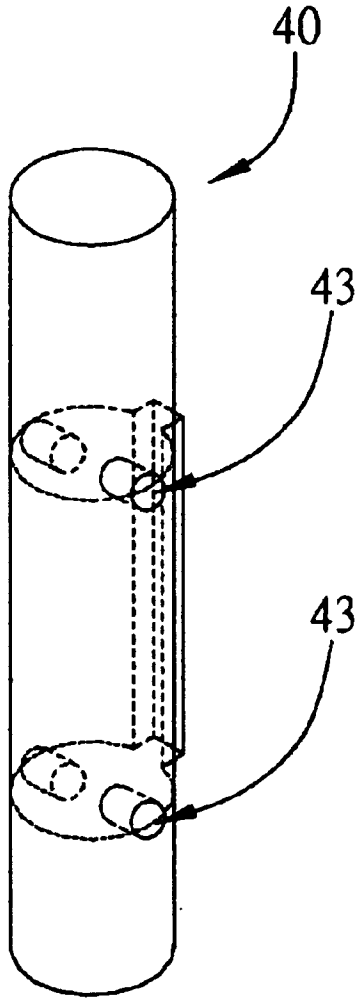
FIG. 4 is a schematic diagram of the first shaft of the twin-cylinder rotary engine according to the first embodiment of the present invention.

The driving disk 4, illustrated in FIG. 3, is a circular driving disk with a certain thickness. Ten screw openings 41, penetrating the first surface 4*a* and the second surface 4*b*, are placed on the surface of the driving disk 4 for securing the rotational cylinder 5 to the first surface 4*a* of the driving disk 4 by method of screw fastening. The rotational cylinder 5 rotates together with the driving disk 4 in a circular track. Two screw mounts 42 are placed in the center of the driving disk 4 for securing the driving disk 4 into the first shaft 40 via screw opening 43. The first shaft 40 provides the rotary engine 1 with the drive source from an externally coupled starting motor (not shown). The starting motor drives the driving disk 4 to rotate which further drives the rotational cylinder 5 that is attached to the first surface 4*a* of the driving disk 4 and both the driving disk 4 and the rotational cylinder 5 rotate synchronously about the first shaft 40. At the same time, two openings 45 are placed on the first and second surface 4*a*, 4*b* of the driving disk 4. The two openings 45 correspond to the location of the rotational cylinder 5 and allow the second shaft 60 of the rotational cylinder 5 to penetrate the openings 45 to expose from the second surface 4*b* of the driving disk 4. The diameter of the openings 45 is slightly larger than that of the second shaft 60, so the second shaft 60 will not make contact with the driving disk 4, thus avoiding friction under rotation. Recessed sections 44 on the surface of the driving disk 4 are created to decrease the weight of the driving disk 4 to decrease the load on the external starting motor during power-up, and to further provide air cooling. The shape and geometry of the recessed sections 44 are not limited to what is shown in the diagrams and disclosed in the embodiments as long as they do not affect the operation and performance of the present invention.

Figure 5:
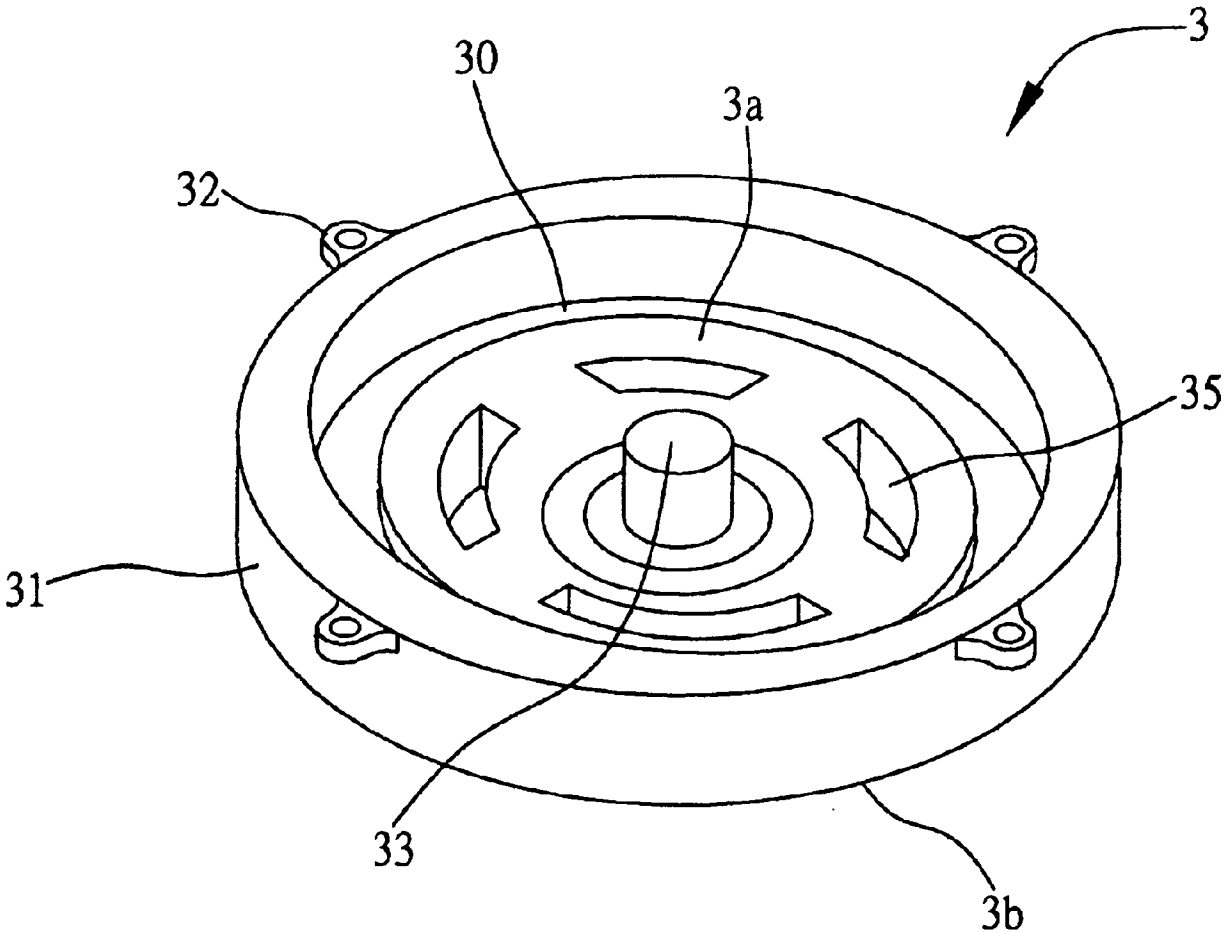
FIG. 5 is a schematic diagram of the cover plate of the twin-cylinder rotary engine according to the first embodiment of the present invention.

FIG. 5 shows a circular cover plate 3 having a first surface and a second surface. This embodiment uses a pair of the cover plates 3. An outer wall 31 of the cover plate 3 having a specific height encloses with the first surface 3*a* and defines an elliptic track 30 on the first surface 3*a*. Four screw mounts 32 are integrally formed on the outer wall 31 for mounting to the screw mounts 25 on the top and bottom surface 2*a*, 2*b* of the circular stationary cylinder 2. The two cover plates 3 respectively couple to the top and bottom of the stationary cylinder 2. The location and size of the outer wall 31 and the screw mounts 32 must match those on the outer wall 20*a* of the stationary cylinder to create a hermetically closed space when the cover plate 3 is attached to the top and bottom surface 2*a*, 2*b*. The aforementioned closed space defines the first cavity 24 of the stationary cylinder 2. Furthermore, an opening 33 is placed on the cover plate 3 for mounting to the first shaft 40 of the driving disk 4 by penetrating the first shaft 40 through the opening 33 of the cover plate 3 and fixing to the rolling bearing 34 on the second surface 3*b* of the cover plate 3 (see FIG. 1A). The rolling bearing 34 has a large contact surface area for securing the first shaft during rotation and providing a stable rotation at high rpm and also reducing rotational friction when the external motor drives the first shaft 40. Furthermore, the diameter of the opening 33 is slightly larger than that of the first shaft 40 so the first shaft 40 only makes contact with the bearing 34 and will not contact with the cover plate 3, thus avoiding friction at high rpm. Arc opening sections 35 on the surface of the cover plate 3 are created to reduce the weight of the cover plate 3 and also increase the air cooling effect of the rotary engine 1. The shape and geometry of the arc opening sections 35 are not limited to what is shown in the diagrams and disclosed in the embodiments as long as they do not affect the operation and performance of the present invention.

Figure 6A:
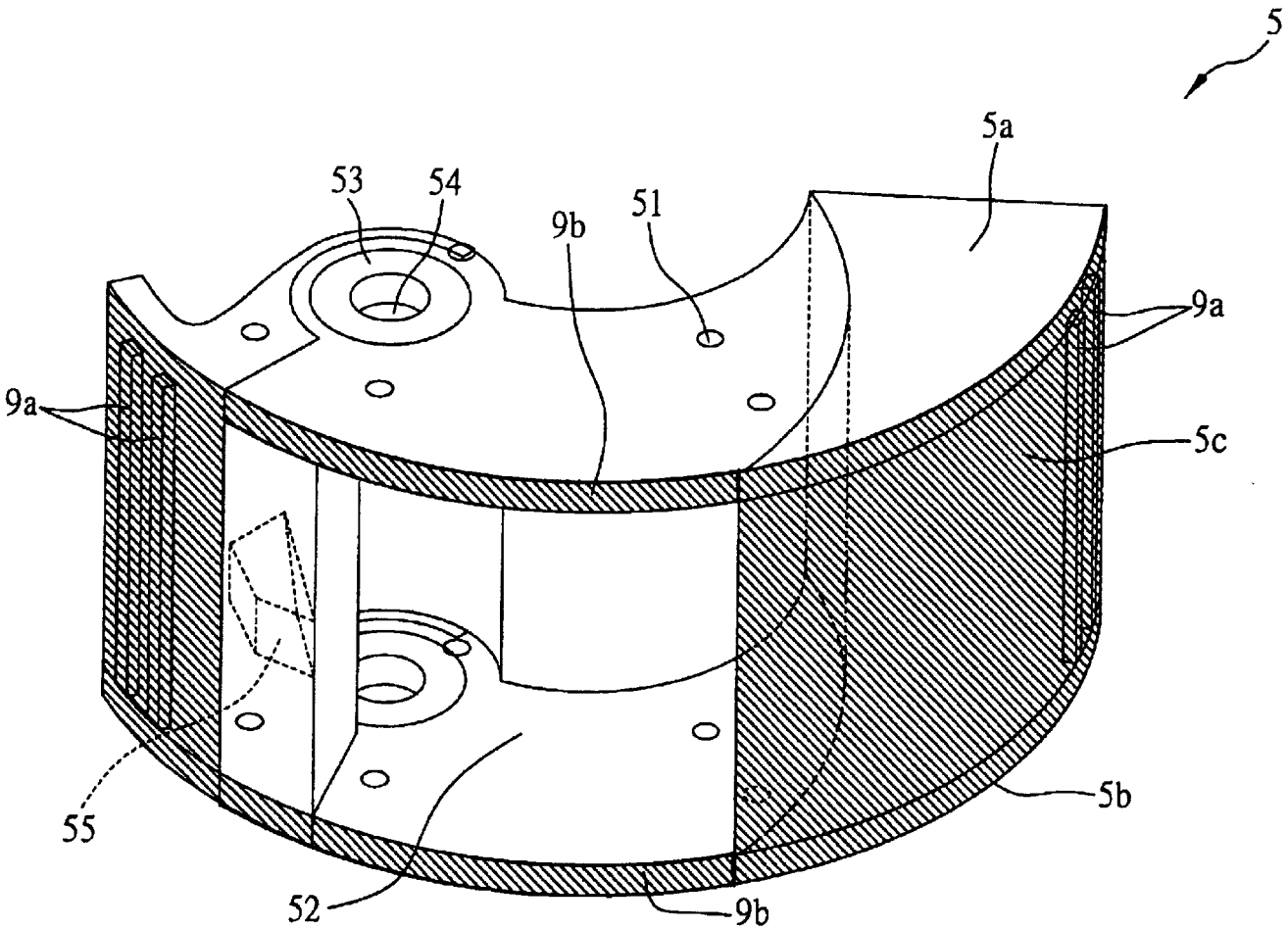
FIGS. 6A and 6B are schematic diagrams of the rotational cylinder of the twin-cylinder rotary engine according to the first embodiment of the present invention.
Figure 6B:
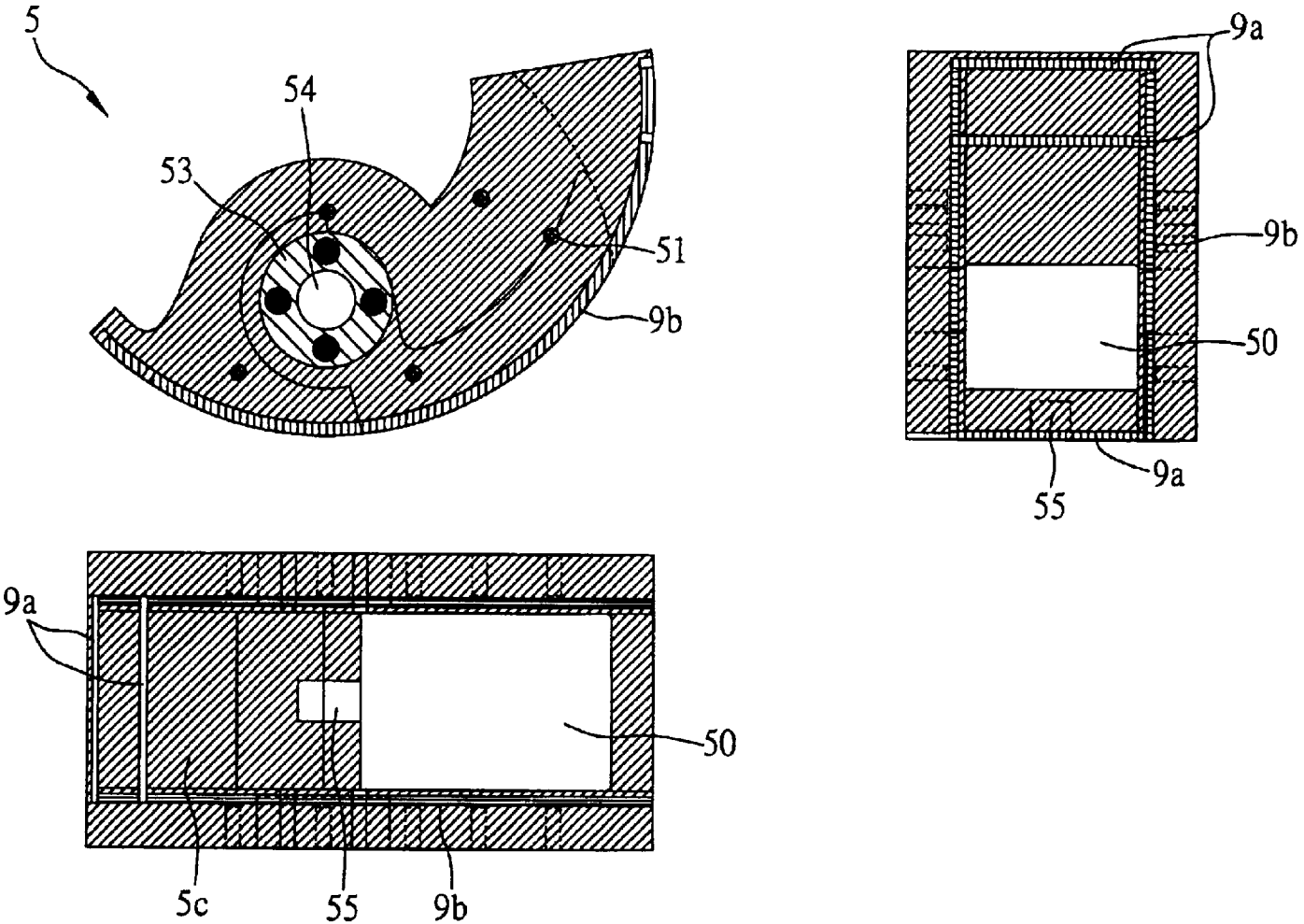

The rotational cylinder 5, shown in FIGS. 6A and 6B, comprises 5 screw mounts 51 on the top and bottom surfaces 5*a*, 5*b* that correspond to the screw mounts 42 on the first and second surfaces 4*a*, 4*b* of the driving disk 4. The rotational cylinder 5 is fastened to the driving disk 4 and driven by the driving disk 4. The shape and geometry of the rotational cylinder 5 are not limited to what is shown in the diagrams and disclosed in the embodiments, but the surface 5*c* of the rotational cylinder 5 needs attention because it makes contact with the inner wall 20*b* of the stationary cylinder 2. The rotational cylinder 5 needs to be able to rotate smoothly in the inner wall 20*b* of the stationary cylinder 2, so the curvature in the inner wall 20*b* of the stationary cylinder 2 should be the same as the one of the rotational cylinder 5 to make sure a well-matched contact in between them then the surface 5*c* will not have any leakage through the surface 20*b* while passing by the intake aperture 21 and the exhaust aperture 22. An intake/exhaust window 50 (FIG. 6B) is placed on the arc surface 5*c* of the rotational cylinder 5 and its location and size will be determined by the need of design. The intake/exhaust window 50 needs to provide enough gas mixture in the second cavity 52 when the rotational cylinder 5 passes the intake aperture 21 of the stationary cylinder 2 and the gas mixture enters the second cavity 52 from the intake aperture 21 of the stationary cylinder 2 via the intake/exhaust window 50 of the rotational cylinder 5. At the same time, on the surface 5*c* of the rotational cylinder 5 close to the second shaft 60, a combustion chamber 55 is opened internally to provide the utilization of an ignition step, wherein the location of the chamber 55 is set to match the location of the spark plugs 23*a* of the ignition aperture 23. Furthermore the temperature of the second cavity 52 of the rotational cylinder 5 is the highest during the operation of the rotary engine 1, therefore, another window (not shown) can be placed in the inner wall of the rotational cylinder 5 facing the first shaft and heat dissipating fins (not shown) and having the same area can be respectively mounted to the top and bottom surfaces 5*a*, 5*b* of the rotational cylinder 5 to increase the efficiency of air cooling of the second cavity.

Figure 7A:
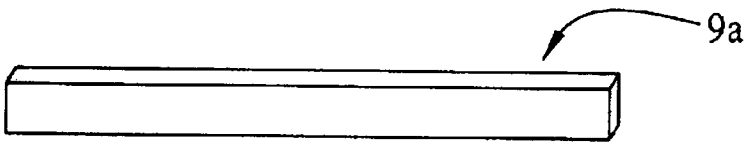
FIGS. 7A to 7C are schematic diagrams of all types of seal guides of the twin-cylinder rotary engine according to the first embodiment of the present invention.
Figure 7B:
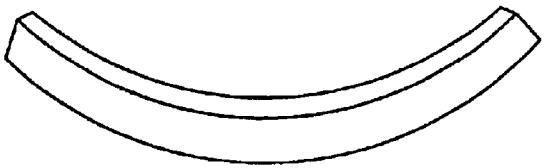

In order to prevent gas leakage and to reduce the contact friction during the operation of the rotational cylinder 5, a plurality of seal guides 9 are placed on the outer arc surface 5*c* of the rotational cylinder 5 as illustrated in FIGS. 6A and 6B. The seal guides 9 are made of high temperature and wear-resistant material and can withstand the friction from the direct contact between the outer surface 5*c* of the rotational cylinder 5 and the inner wall 20*b* of the stationary cylinder 2. The thermal volume expansion of the seal guides 9 needs to fill up the gap between rotational cylinder 5 and the stationary cylinder 2 to prevent gas leakage when the rotational cylinder 5 passes the intake aperture 21 and the exhaust aperture 22. The location and number of seal guides are not limited to what is shown in the diagram or is disclosed in this embodiment. The number of seal guides can be as high as desired to increase performance, but reduced to having only one at each of the four corners on the arc surface of the rotational cylinder 5 if material cost is an issue. FIGS. 6A and 7A show the straight-type seal guides 9*a* and FIGS. 6A and 7B show the curve-type seal guides 9*b* (the curvature is identical to the outer surface 5*c* of the rotational cylinder 5). In this embodiment, besides the use of seal guides on the outer surface 5*c* of the rotational cylinder 5, the straight-type seal guides 9*a* are also used on the neighboring sides of the outer surface 5*c* to close the gap between the rotational cylinder 5 and the intake/exhaust aperture 21, 22 to increase sealing so as to reduce the gas leakage during approach or departure.

Figure 8:
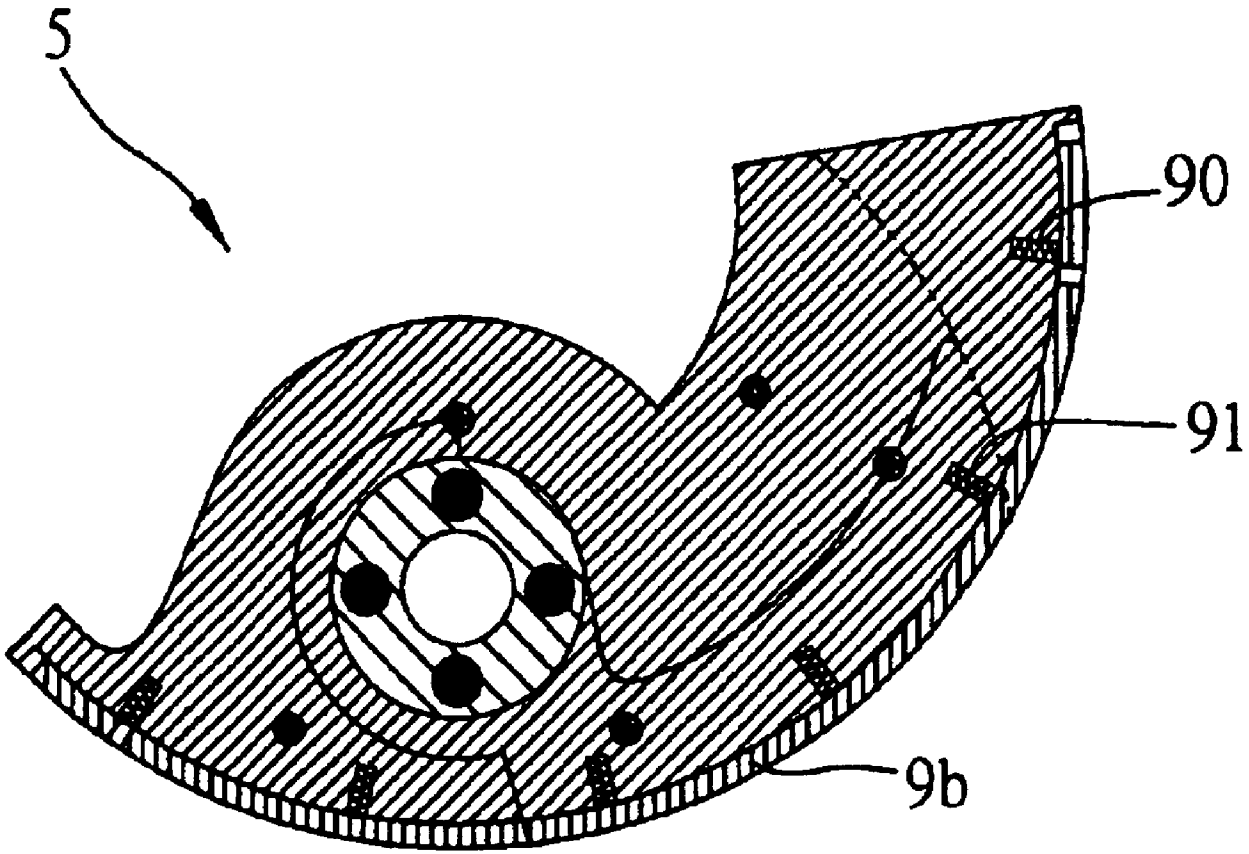
FIG. 8 is a schematic diagram showing an example of mounting the curve-type seal guide on the rotational cylinder according to the first embodiment of the present invention.
Figure 9A:
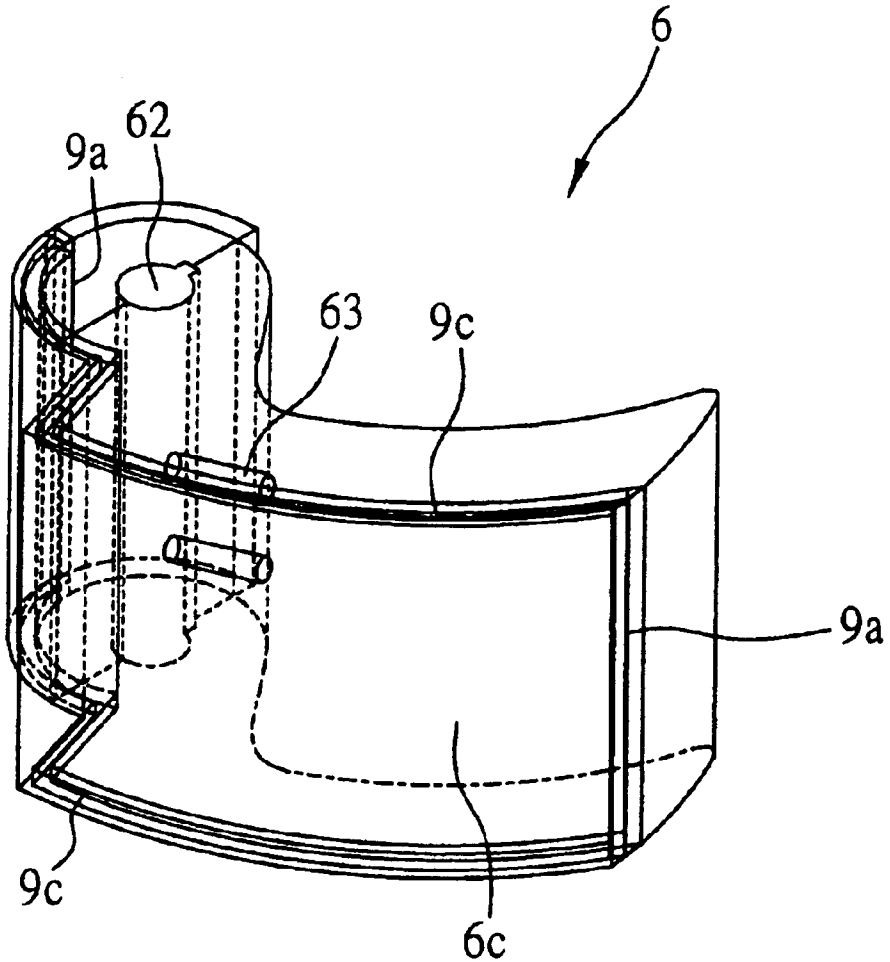
FIGS. 9A and 9B are schematic diagrams of the swing piston of the twin-cylinder rotary engine according to the first embodiment of the present invention.
Figure 9B:
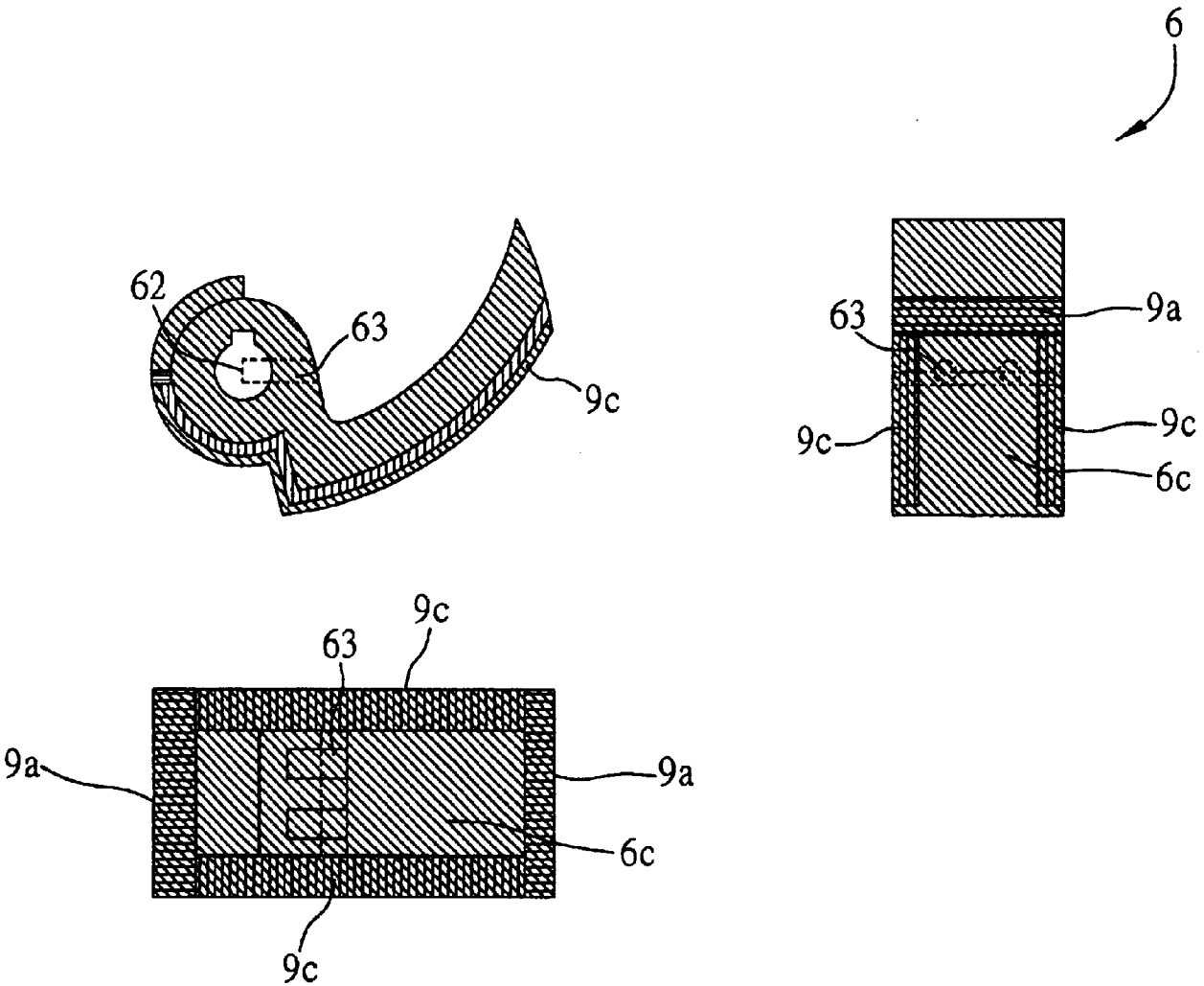
Figure 10:
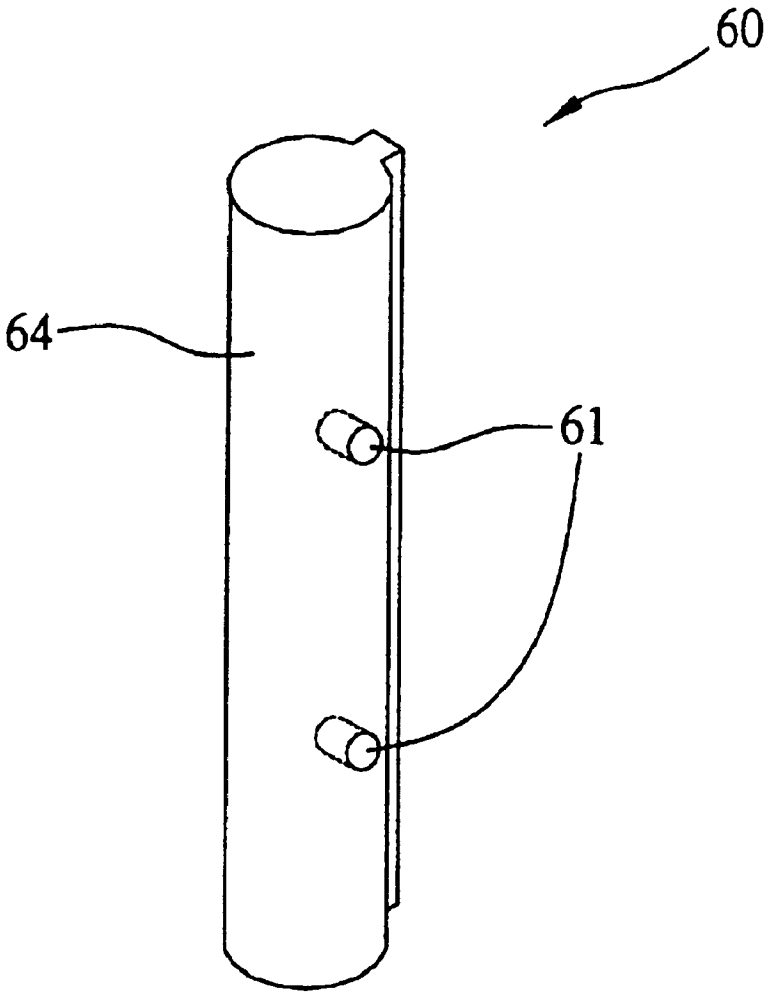
FIG. 10 is a schematic diagram of the second shaft of the twin-cylinder rotary engine according to the first embodiment of the present invention.

The present invention provides two designs to minimize the gas leakage by the use of seal guides 9. The first method is to choose a flexible material that has a high coefficient of thermal expansion and high temperature resistance so that the seal guides 9 can easily expand and fill up the gap between the outer surface 5*c* of the rotational cylinder 5 and the inner wall 20*b* of the stationary cylinder 2 under the high temperature induced by the rotation of the rotary engine 1. The second method is to provide a ditch 91 attached by a spring 90 at predetermined location, as illustrated in FIG. 8 (using curve-type seal guides 9*b* as an example). Under high-speed rotation of the rotational cylinder 5, the centrifugal force allows the spring to deform outwards to push the seal guides 9*b* outwards to make appropriate contact with the inner wall 20*b* of the stationary cylinder 2 and fill in the gap, which achieves a similar sealing effect. The choice of either method could weigh the material cost for the first method and the manufacturing cost for the second method. FIGS. 9A and 9B show the arc-shaped swing piston 6 in the rotational cylinder 5. An opening 62 is placed on the swing piston 6 for insertion of the second shaft 60. After the second shaft 60 penetrates through the opening 62, the swing piston 6 is fastened to the screw hole 61 (see FIG. 10) of the second shaft 60 by screwing through two screw mounts 63 located on the swing piston 6 (see FIG. 10). The slight rotation of the second shaft in the rotational cylinder 5 causes the swing piston 6 to swing in the second cavity of the rotational cylinder 5.

Figure 7C:
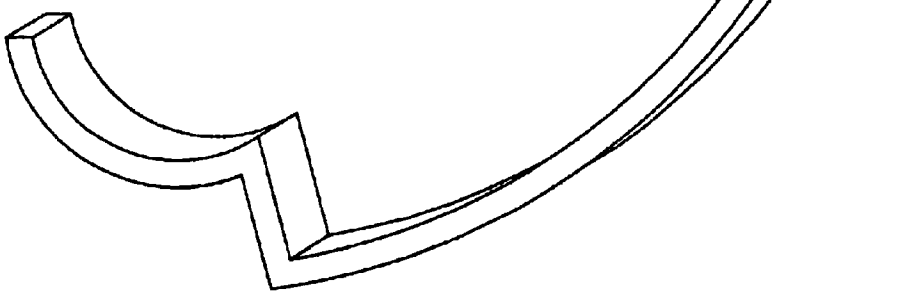

Because the swing piston 6 is securely fastened, the friction of the swing piston 6 due to the speedy movement found in prior art is eliminated. The curvature of the swing piston 6 is similar to that of the outer surface 5*c* of the rotational cylinder 5 so the swing piston 6 can smoothly swing in the second cavity 52 of the rotational cylinder 5 to prevent gas leakage. The seal guides 9 are also placed on outer surface 6*c* of the swing piston 6 near the intake/exhaust apertures 50 of the rotational cylinder 5. The seal guides 9 made of high-temperature and wear-resistant material can be divided into straight-type 9*a* (as in FIGS. 7A and 9A) and folded curve-typed 9*c* (as in FIGS. 7C and 9A). The seal guides 9 are the same as those used on the rotational cylinder 5 and again the designer can choose between using a flexible material with high heat expansion and using a spring 90 (as in FIG. 8) to increase the sealing effect in filling the gap.

The assembly relation among the aforementioned cover plates 3, the driving disks 4, the rotational cylinders 5, and the swing piston 6 is illustrated in FIGS. 1A and 1B. There is a pair of cover plates 3 and a pair of driving disks 4 which are respectively fastened to the top and bottom of the stationary cylinder 2, and the rotational cylinders 5 are sandwiched in between the two driving disks 4. The first shaft 40 providing the drive source penetrates and fastens to the center of the top and bottom driving disks 4 and its two ends are respectively exposed out of the second surface 4*b* of the driving disks 4 and are also respectively exposed from the top and bottom cover plates 3. The first shaft 40 is secured on two roller bearings 34 on the surface 3*b* of the cover plates 3. The cover plates 3, the driving disks 4, the first shaft 40, and the rotational cylinders 5 are all assembled inside the stationary cylinder 2 and a first cavity 24 is formed by mounting the top and bottom cover plates 3 to the stationary cylinder 2 and fastening them together by screws. While an external starting motor provides the drive source to the first shaft 40 and then to the driving disks 4, the driving disks 4 drive a pair of rotational cylinders 5 on opposite sides (FIG. 1B) in the first cavity 24, allowing the two rotational cylinders 5 to rotate along the inner wall 20*b* of the stationary cylinder 2 in a circular orbit, and to passes the intake aperture 21, the ignition aperture 23, and the exhaust aperture 22 in sequence to perform the intake, compression, combustion, and exhaust phases of a rotary engine 1. Furthermore the diameter of the driving disks 4 is slightly smaller than the inner wall 20*b* of the stationary cylinder 2 as in FIG. 1 so the driving disks 4 do not come in contact with the inner walls 20*b* of the stationary cylinder 2 during rotation, thus avoiding unnecessary contact friction.

The assembly relation between the rotational cylinder 5 and the swing piston 6 is shown in FIGS. 1B, 6A, and 6B. The opening 54 and the roller bearing 53 are formed on the top and bottom surfaces 5*a*, 5*b* of the rotational cylinder 5, and the second shaft 60 penetrates through the rotational cylinder 5 via the opening 54 and the roller bearing 53 and exposes outside of the top and bottom surface 5*a* and 5*b* of the rotational cylinder 5. At the same time the swing piston 6 is secured on the second shaft 60 and swings in the second cavity 52 of the rotational cylinder 5 according to the slight rotation of the second shaft. Furthermore, the bearing 53 is used to reduce the friction when the second shaft is under rotation. And the diameter of the opening 54 is slight larger than that of the second shaft 60 so the second shaft 60 is only in contact with the bearing 53 but not with the rotational cylinder 5 so that the contact friction between the top and bottom surface 5*a* and 5*b* can be reduced.

After assembly of the cover plates 3, the driving disks 4, the rotational cylinders, and the swing piston 6, the operation of the rotary engine 1 of the present invention is ready for use. The operation is described in detail (as in FIG. 1B): when the first shaft 40 drives the driving disks 4 and then the rotational cylinders 5, the rotational cylinders 5 rotate in a clockwise direction along the inner wall 20*b* of the stationary cylinder 2. The second shaft 60 dragged by the driving wheel assembly 7 performs a slight rotation (described later in detail) to swing the swing piston 6. The swing of the swing piston 6 is designed to cooperate with all the specified rotational positions of the rotational cylinder 5. When the rotational cylinder 5 passes by the intake aperture 21 of the stationary cylinder 2, the swing piston 6 spans a space by swinging its tail away from the inner wall 20*b* of the stationary cylinder 2 inside the second cavity 52 for the intake operation. After the rotational cylinder 5 passes by the intake aperture 21, the swing piston 6 compresses the air by swinging its tail toward the inner wall 20*b* of the stationary cylinder 2. Then, when the rotational cylinder 5 passes the ignition aperture 23, the spark plug 23*a* provides the combustion for generating power. The power is then transmitted from the rotational cylinders 5 to the driving disks 4 and then to the first shaft 40 and then to the outside system. Finally, when the rotational cylinder 5 passes the ignition aperture 23, the swing piston 6 exhausts all the gas in the second cavity 52 of the rotational cylinder 5 by swinging its tail toward the inner wall 20*b* of the stationary cylinder 2. After the exhaust gas leaves from the exhaust aperture 22, one cycle has been completed.

This present embodiment shows only a single intake aperture 21, exhaust aperture 22, and ignition aperture 23 disposed on the outer wall 20*a* such that a complete cycle is done in one revolution of the first shaft 40. At the same time, the present invention has two sets of rotational cylinders 5 on opposite sides, so that when the first shaft 40 drives the two rotational cylinders 5 and makes one revolution, the rotary engine 1 can generate twice the combustion and power output (each rotational cylinder 5 generates once per revolution). The aforesaid description is the operation theory behind the output power of the rotary engine 1 of the present invention.

Figure 11A:
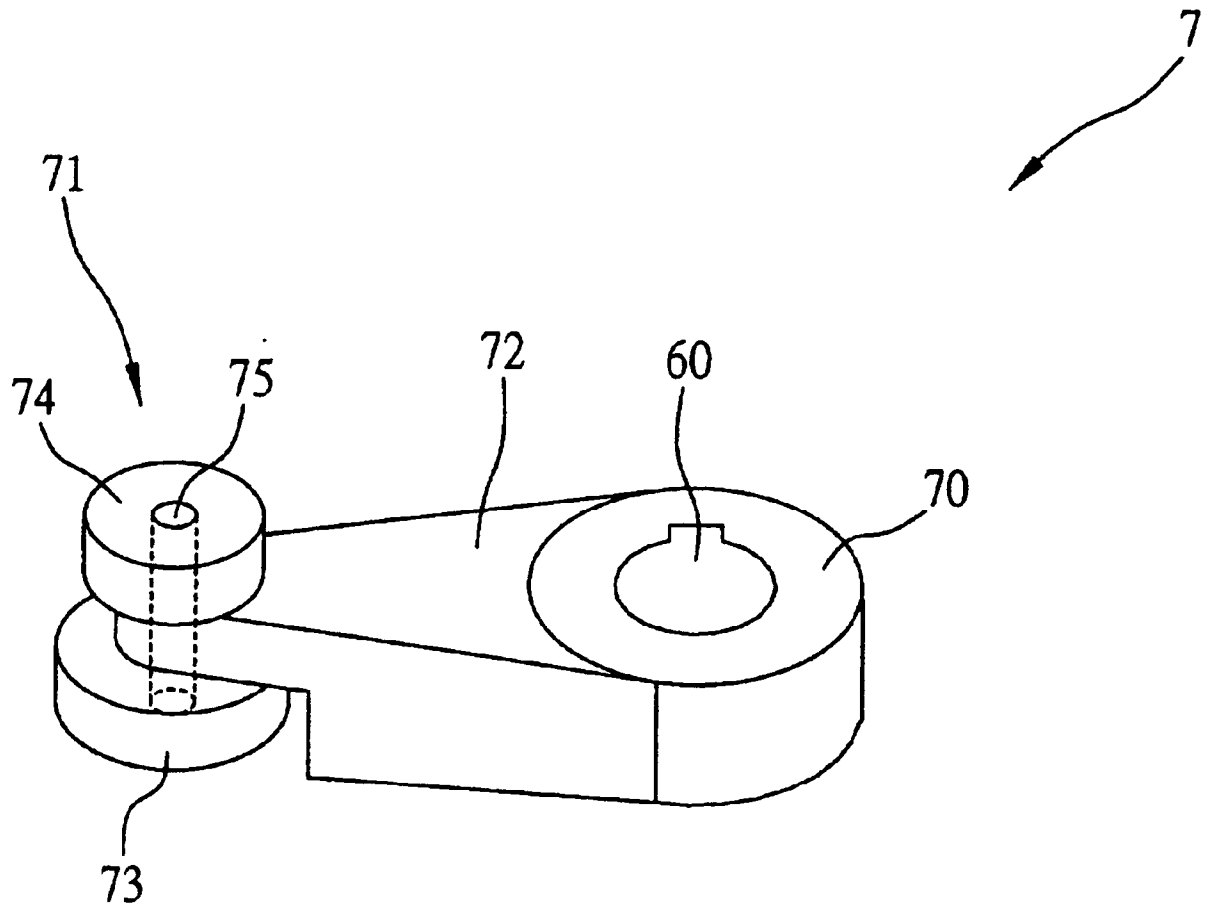
FIGS. 11A and 11B are schematic diagrams of the driving wheel assembly of the twin-cylinder rotary engine according to the first embodiment of the present invention.
Figure 11B:
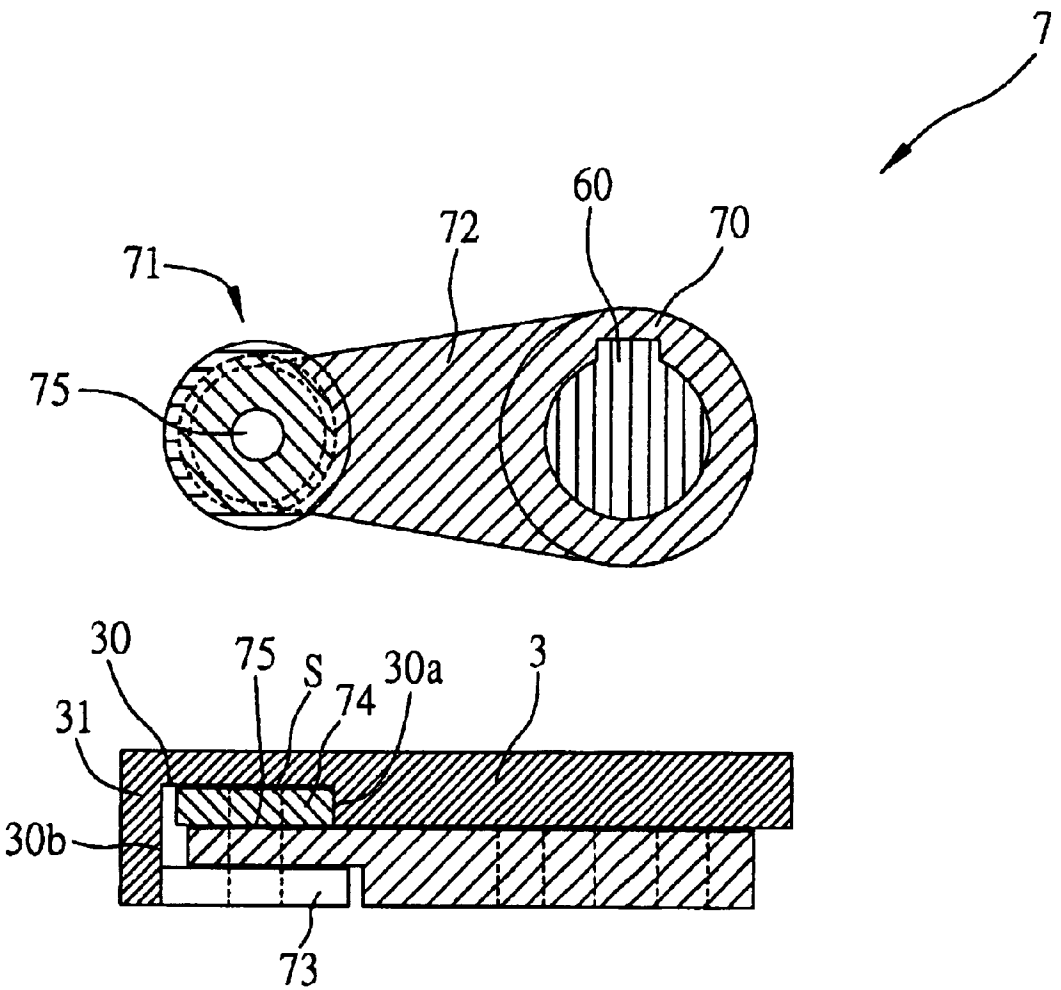

The key of the aforementioned operation theory lies in the precise combination of the swing of the swing piston 6 and the rotational position of the rotational cylinder 5, as shown in FIGS. 11A and 11B. This combination is accomplished by the design of the special driving wheel assembly 7 of the present invention that can cause the second shaft 60 to deflectively rotate to swing the swing piston 6 securely mounted on the second shaft 60. As illustrated in the diagram, the driving wheel assembly 7 comprises a leading wheel set 71, a driven wheel set 70, and a connecting arm 72 that couples the two wheel sets 70, 71, wherein the leading wheel set 71 comprises a big wheel 73, a small wheel 74, and an axle 75 that couples the big wheel 73 and the small wheel 74 and constrains them to rotate on the axle 75. The two ends of the connecting arm 72 are secured to the axle 75 and the driven wheel set 70 respectively. And, the driven wheel set 70 is also secured to the second shaft 60 by penetrating therein.

The driving wheel assembly 7 is located between the first surface 3*a* of the cover plates 3 and the second surface 4*b* of the driving disks 4 (in FIG. 1A). The leading wheel set 71 can be placed in the elliptic track 30 on the surface 3*a* of the cover plates 3 and driven by the driving disks 4 to rotate along the elliptic track 30. The drag created by the driving disk 4 will drive the rotational cylinders 5 mounted onto the driving disks 4 and the second shafts 60 inserted into the rotational cylinders 5 to rotate together, wherein the rotation orbit is circular. At the same time, the second shaft 60 drives the driven wheel set 70 and the connecting arm 72 secured to the driven wheel set 70 to rotate circularly because the exposed part 64 (as in FIG. 1A) of the second shaft 60 exposed from the second surface 4*b* of the driving disks 4 is coupled to the driven wheel set 70. The second shaft 60 drives the driven wheel set 70 and further drives the axle 75 via the connecting arm 72 to cause the big wheel 73 and the small wheel 74 (i.e. the leading wheel set 71) to rotate along the elliptic track 30 on the cover plates 3. At this time, the rotation of the leading wheel set 71 is elliptic but the rotation of the driven wheel set 70 is circular, so this operation creates a deviation in orbit which leads to an opposite drag force. Thus, the leading wheel set 71, shown in FIG. 1B, deviates from the circular orbit 27 of the driven wheel set 70 at the locations A or B, and the connecting arm 72 coupling the two wheel set 70, 71 will generate a drag force from the driven wheel set 70 which pulls the fixed driven wheel set 70 to make the second shaft 60 rotate deflectively. Then, the swing piston 6 is secured to the second shaft 60 so the swing of the swing piston 6 in the rotational cylinder 5 is achieved to demonstrate the theory of the present invention.

A more detailed description of the operation of the driving wheel assembly 7 is given according to FIG. 1B. As illustrated in the diagram, when the external motor drives the rotational cylinder 5 to rotate in a circularly clockwise direction inside the stationary cylinder 2, it also drives the leading wheel set 71 to rotate along the elliptic track 30. When the leading wheel set 71 passes location B, the deviation between the elliptic track 30 and the circular orbit is gradually increasing. At this time, the swing piston 6 swings towards the first shaft 40 (away from the inner wall 20*b* of the stationary cylinder 2) causing the intake/exhaust space of the rotational cylinder 5 to increase to perform the intake operation. Oppositely, when the leading wheel set 71 passes the location A, it shows the deviation between the elliptic track 30 and the circular orbit 27 is gradually decreasing. At this time, the swing piston 6 swings towards the inner wall 20*b* of the stationary cylinder 2 (away from the first shaft 40) causing the intake/exhaust space of the rotational cylinder 5 to decrease to perform the compression operation or prepare for the next intake. Furthermore, from FIG. 1B, it can be seen that the location of the intake aperture 21 and exhaust aperture 22 on the stationary cylinder 2 need to cooperate with the elliptic track 30. The intake aperture 21 and the exhaust aperture 22 should be situated after location A where the deviation between the elliptic track 30 of the leading wheel set 71 and the circular orbit 27 is gradually increasing. However the precise location depends on the requirements for power and intake/exhaust volume used by the designer. Furthermore, besides adjusting the location of the intake aperture 21 and the exhaust aperture 22, the designer can also adjust the ratio of the long and short distance of the elliptic track 30 to cause the swing piston 6 to generate different swing degrees to adjust power output efficiency and intake/exhaust volume.

In the aforementioned driving wheel assembly 7, due to the difference between the elliptic track 30 of the leading wheel set 71 and the circular orbit of the driven wheel set 70, if the design is not optimal, the pulling force between the two wheel set 70, 71 will create additional friction, which will decrease the performance of the rotary engine. The problem is particularly serious for the unfixed leading wheel set 71. The present invention uses a special design to reduce friction as shown in FIG. 11B, wherein a small gap S is provided between the small wheel 74 and the elliptic track 30 so that the small wheel 74 is only in contact with the inner side 30*a* of the elliptic track 30, and, in the same way, the big wheel 73 is designed to be only in contact with the outer side 30*b* of the elliptic track 30 (i.e. the inner side of the outer wall 31 of the cover plates 3). This special design allows the big wheel 73 and the small wheel 74 to only contact the outer side 30*b* and inner side 30*a* respectively during the elliptic revolution, and allows the big wheel 73 and the small wheel 74 to self-rotate about the axle 75 in a counterclockwise and clockwise direction respectively during the same elliptic revolution to decrease friction to a minimum.

Furthermore, the leading wheel set 71 is not limited to the combination of the big wheel 73, the small wheel 74, and the axle 75. Any leading member rotating along the elliptic track 30 and securing to the connecting arm 72 can achieve the same effect, such as the leading wheel set 71 being replaced with an elongated cylinder connected to a connecting arm and the elongated cylinder is placed into the elliptic track 30 to drive the swing piston 6 to achieve the same effect as the aforementioned design. The only problem is that the elongated cylinder will increase friction that might reduce the smoothness in the operation of the present invention.

Figure 12:
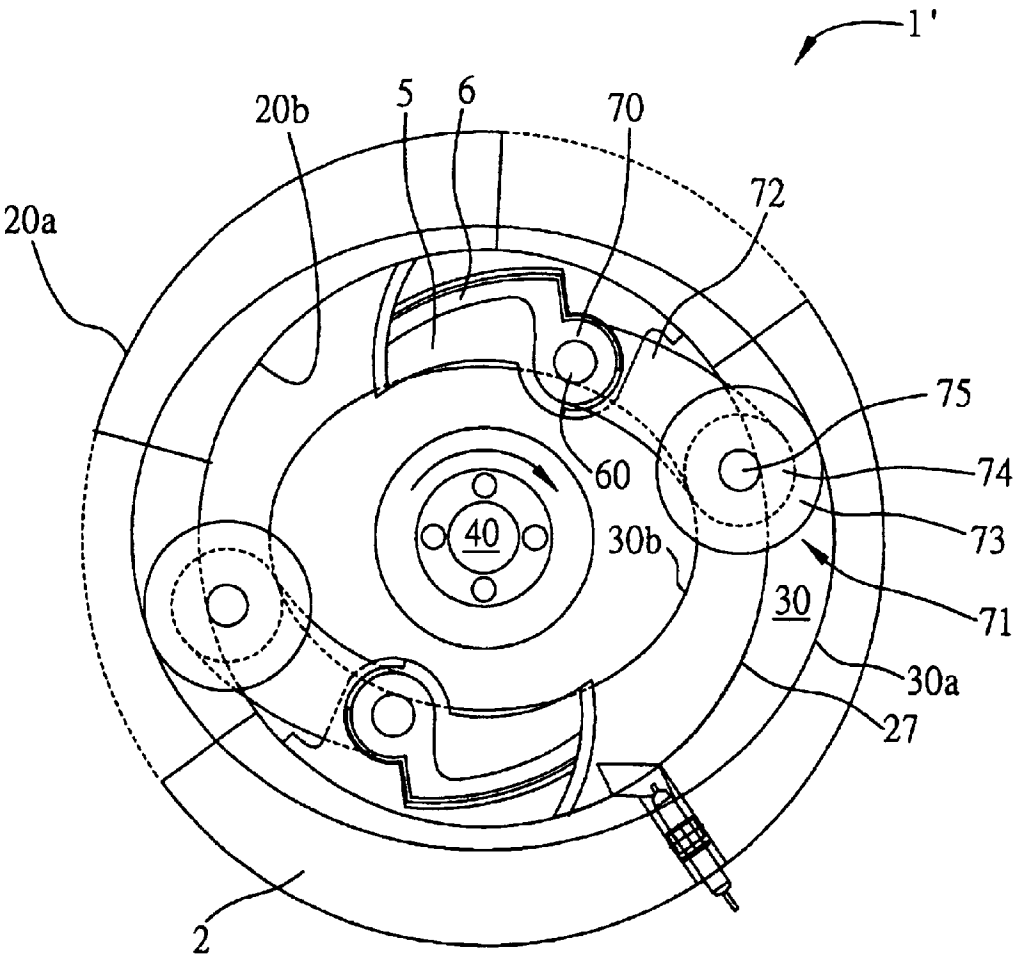
FIG. 12 is a schematic diagram of the twin-cylinder rotary engine according to the second embodiment of the present invention.
Figure 13:
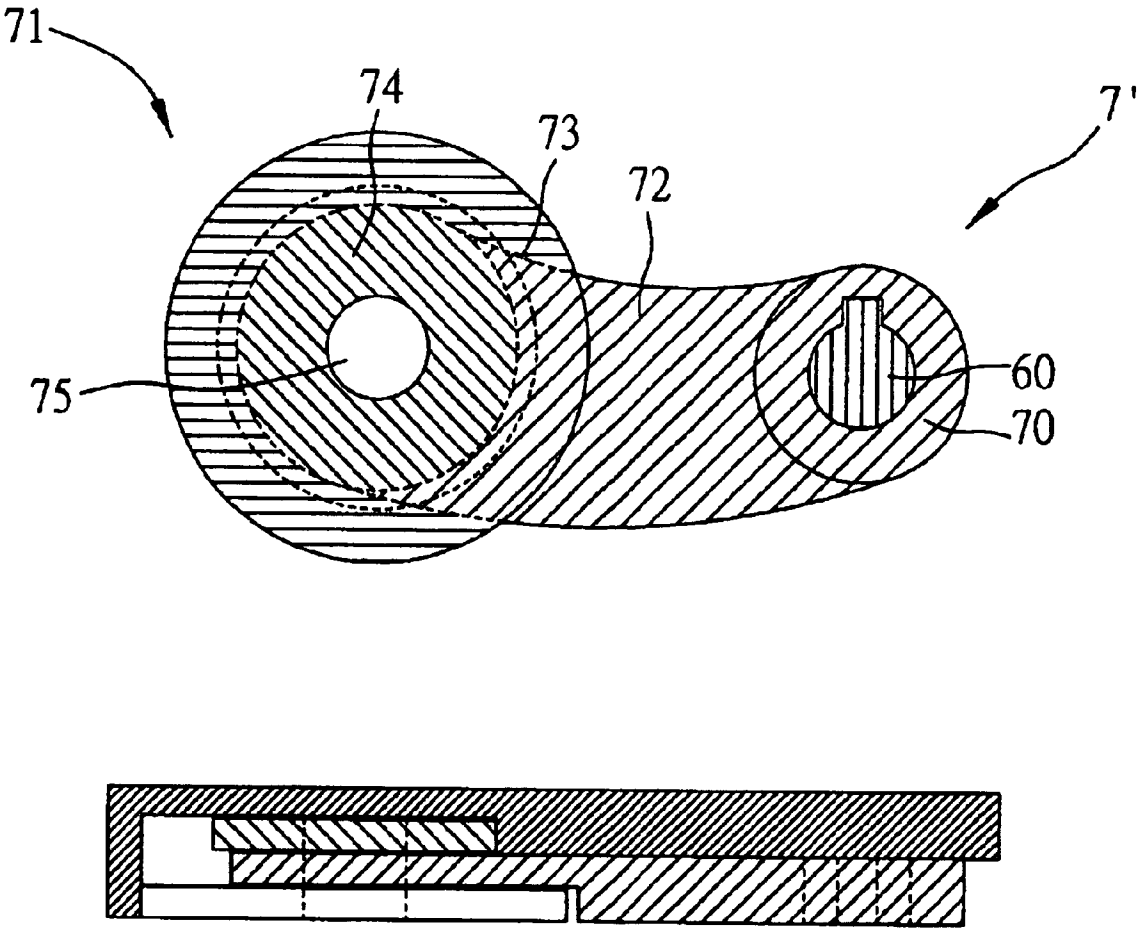
FIG. 13 is a schematic diagram of the driving wheel assembly of the twin-cylinder rotary engine according to the second embodiment of the present invention.

Besides the rotary engine of the first embodiment of the present invention, a second embodiment is provided where the cover plates 3 and the driving wheel assembly 7 are changed. FIG. 12 shows the second embodiment of the present invention. The inner side 30*a* of the elliptic track 30 of the cover plates 3 is reduced so that the distance between the first shaft 40 and the elliptic track 30 is shortened. As a result, the width of the elliptic track 30 is increased. And at the same time, the size of the leading wheel set 71 is increased and the curvature of the connecting arm 72 is also changed. This design has the leading wheel set 71 placed in the wider elliptic track 30 and the connecting arm 72 can smoothly connect the leading wheel set 71 and the driven wheel set 70, wherein the size and shape of the driving wheel assembly 7 is shown in FIG. 13. The second embodiment reduces the rpm of the driving wheel assembly 7 during the operation of the rotary engine 1 and therefore reduces the friction induced by the elliptic track 30. When the width of the elliptic track 30 and the sizes of the big wheel 73 and the small wheel 74 of the leading wheel set 71 increase simultaneously, the self-rotational cycle number of the big wheel 73 and the small wheel 74 along the elliptic track 30 decreases. That is, when the big wheel 73 and small wheel 74 rotate along the elliptic track 30 one revolution, the self-rotations about the axle 75 are also almost reduced to one revolution, and therefore the contact friction of the big wheel 73 and the small wheel 74 at high rpm is virtually eliminated. Furthermore, because of the enlarged diameter and size of the leading wheel set 71, the center of mass of the driving wheel assembly 7 is shifted towards the leading wheel set 71 to eliminate the unbalanced center of mass problem that might happen to the above driving wheel assembly 7 which is caused by the linkage of the driven wheel set 70, the second shaft 60, the rotational cylinder 5, and the swing piston 6. Thus, any unstable operation of the driving wheel assembly 7 due to shift in the center of mass is eliminated.

Figure 14:
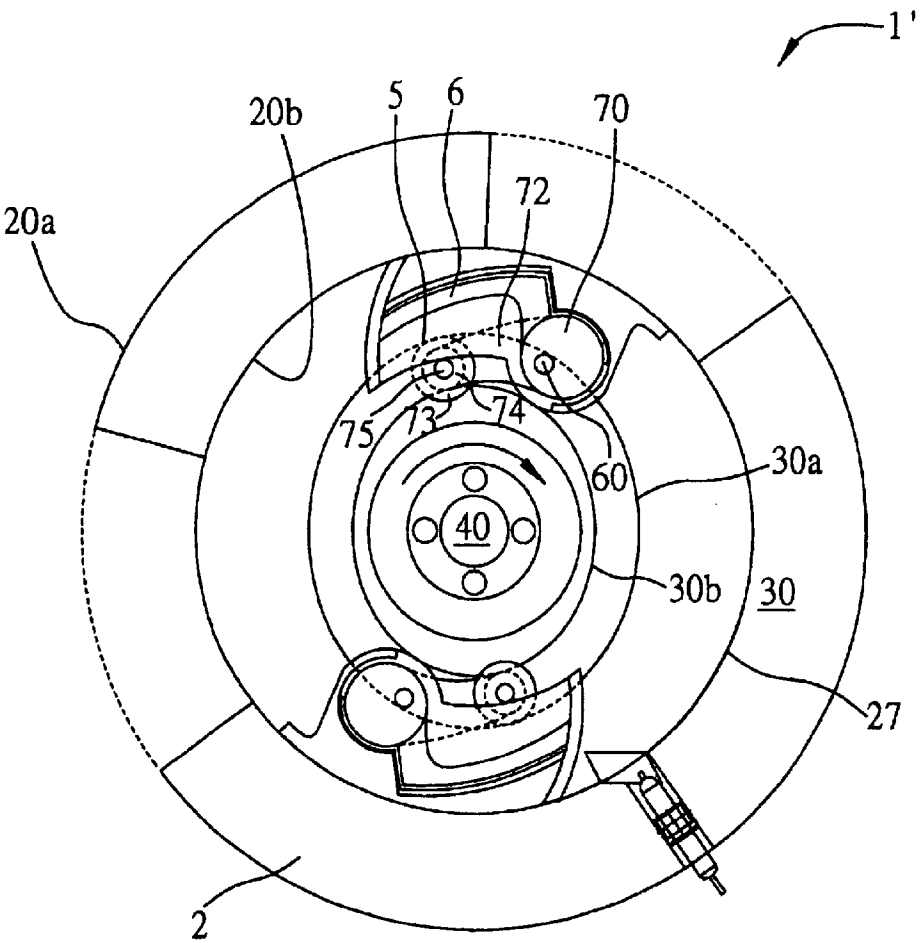
FIG. 14 is a schematic diagram of the twin-cylinder rotary engine according to the third embodiment of the present invention.

The design of the driving wheel assembly 7 can be altered according to the direction of rotation of the driving disks 4. For example, in the above first and second embodiments, it is in the clockwise direction, so the leading wheel set 71 along the elliptic track 30 always rotates ahead of the driven wheel set 70 that rotates in a circular orbit and this might increase the friction on the leading wheel set 71 during operation. If the configuration of the driving wheel assembly 7 is changed as shown in FIG. 14 and associates with the swap of the long and short axis of the elliptic track 30, under clockwise rotation of the driving disks 4 as illustrated in the diagram, the driven wheel set 70 driven by driving disk 4 will rotate ahead of the leading wheel set 71 and this change can reduce the friction caused by the previous forward movement of the leading wheel set 71. At the same time, non-stability due to the shifted center of mass of the driving wheel assembly 7 during operation is eliminated as well. This represents the third embodiment of the present invention.

Figure 15:
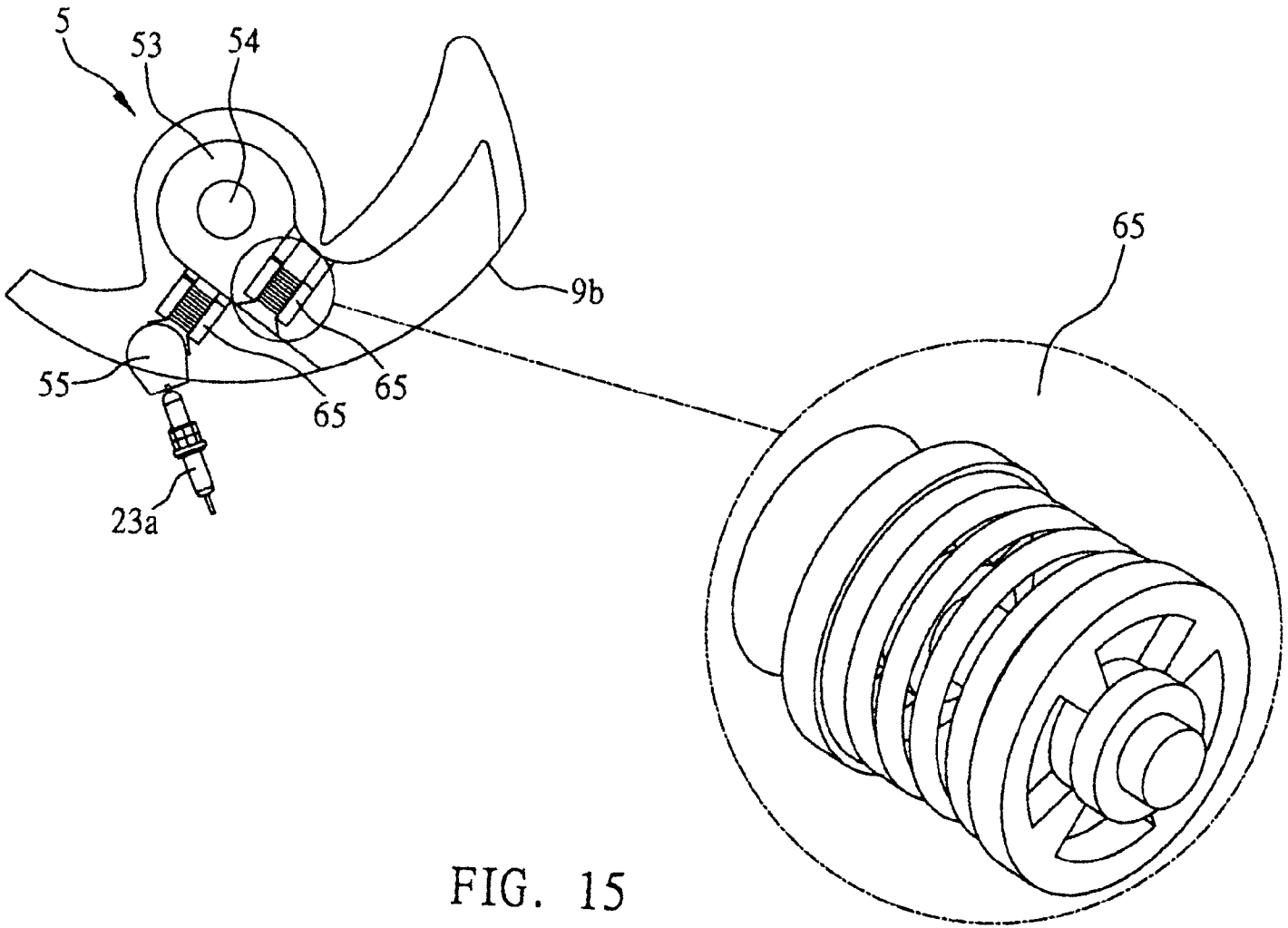
FIG. 15 is a schematic diagram of the one-way valve of the twin-cylinder rotary engine according to the third embodiment of the present invention.

In addition, the following two factors will probably cause pressure on the leading wheel set 71 of the driving wheel assembly 7 and reduce the performance of the present invention. First, the reaction force coming from combustion will push the swing piston 6, and, second, the vacuum in between the rotational cylinder 5 and the swing piston 6 will probably suck the swing piston 6 and affect the driving wheel assembly 7 due to the linkage relation. To release the pressure on the leading wheel set 71 caused by the aforementioned two factors as shown in FIG. 15, a plurality of one-way valves 65 can be placed on both the rotational cylinder 5 and the swing piston 6, wherein the radian of the swing piston 6 is a little different from that in FIG. 6B to decrease the swing angle and accommodate the one-way valves 65.

The other components of the second and third embodiment are identical to those of the first embodiment that are illustrated in the previous diagrams and will not be described in detail.

Figure 16:
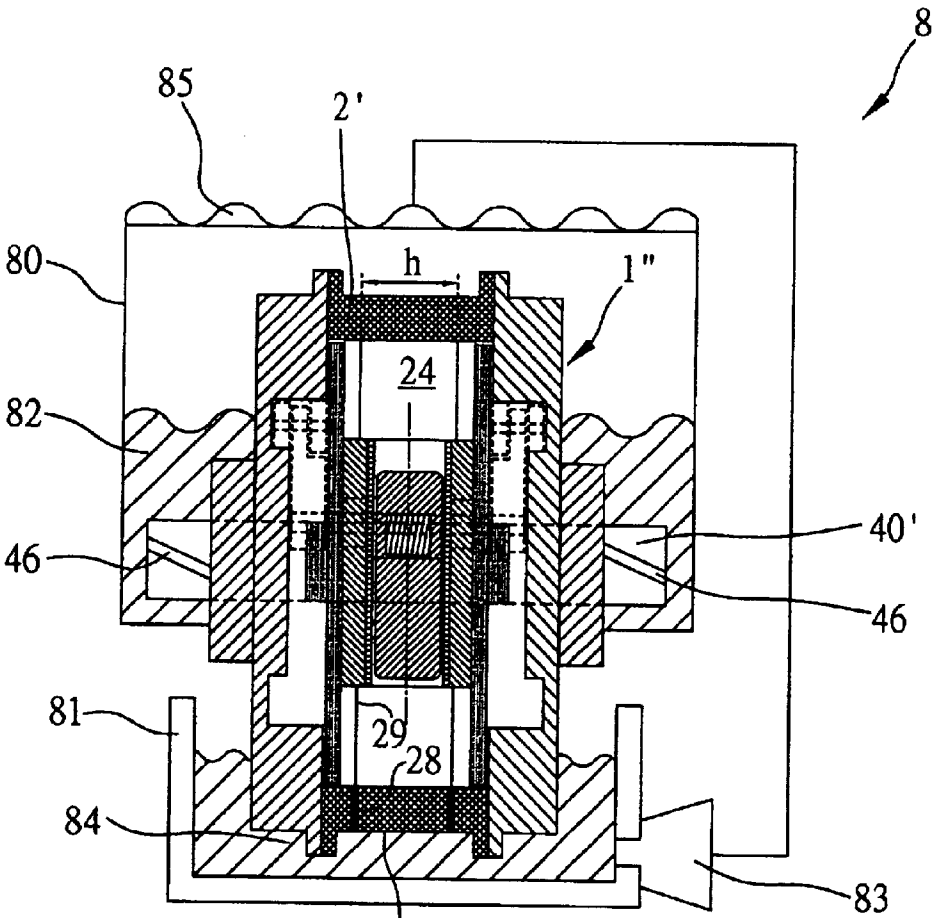
FIG. 16 is a schematic diagram of the lubrication device of the twin-cylinder rotary engine according to the fourth embodiment of the present invention.

In recognition of the high temperature and friction occurring at high rpm in conventional engines, the fourth embodiment of the present invention particularly focuses on the lubrication device 8 of the previous designs. FIG. 16 illustrates, a rotary engine 1" comprising an externally coupled lubrication oil tank 80 and an oil collecting sump 81 located below, wherein the lubricating oil 82 of the lubrication oil tank 80 runs into the first shaft 40' and centrifugal force of the first shaft 40' sprays the lubricating oil 82 into the first cavity 24 of the rotary engine 1". The lubricating oil 82 then runs through the cover plates 3, the driving wheel assembly 7, the driving disks 4, the rotational cylinder 5, and the swing piston 6 to provide lubrication and then is collected at the oil collecting sump 81 through the oil draining ditches 29 and the oil draining holes 28 on the wall of the stationary cylinder 2'. The lubricating oil 82 heats up as it cools various engine parts during circulation and, therefore, the oil collected at the oil collecting sump 81 becomes a hot lubricating oil 84. A pump 83 located in the oil collecting sump 81 pumps the high temperature lubricating oil 84 back to lubrication oil tank 80 for reuse. Consequently, in order to cool down the hot lubricating oil 84 once when it enters the lubrication oil tank 80, the top of the lubrication oil tank 80 is provided with a large heat dissipating fin 85 for cooling down the hot lubricating oil 84 before entering the lubrication oil tank 80 to achieve the effect of a recyclable lubricating coolant.

Figure 17:
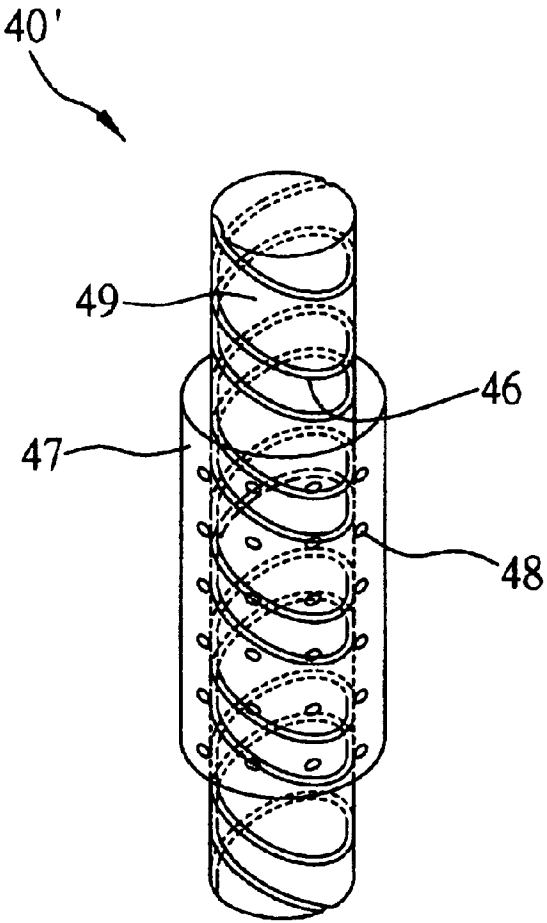
FIG. 17 is a schematic diagram of the first shaft having the ability to spray lubrication oil of the twin-cylinder rotary engine according to the fourth embodiment of the present invention.

In cooperating with the lubrication device 8, various parts of the rotary engine 1 are designed accordingly. First, in order for the lubricating oil 82 of the lubrication oil tank 80 to flow into the first cavity 24 through the first shaft 40', the first shaft 40', as illustrated in FIG. 17, is further modified by adding two twisted spiral-type lubrication oil trenches 46 on the peripheral surface 49 of the first shaft 40'. As a result, the lubricating oil 82 of the lubrication oil tank 80 is channeled to the peripheral surface 49 of the first shaft 40' along the spiral-type lubrication oil trenches 46. Furthermore, the first shaft 40' is inserted into a hollow duct 47 wherein the surface of the hollow duct 47 has a plurality of openings 48 lined up in a row. The purpose of this design is for spraying out the lubricating oil 82 from the spiral-type oil trenches 46 via the openings 48 of the hollow duct 47 to the first cavity 24 for lubrication by centrifugal force generated by the first shaft 40' when the rotary engine 1" is rotating at a high rpm. At this time, the lubricating oil 82 in the first cavity 24 cools both lubricates and cools the cover plates 3, the driving wheel system 7, and the driving disks 4, and because the inner wall of the rotational cylinder 5 facing the first shaft 40' has an window (not shown), the lubricating oil 82 can spray into the second cavity 52 via the window to lubricate and cool the rotational cylinder 5, the swing piston 6, and the seal guides 9 on both surfaces. Furthermore when the lubricating oil 82 flows over the seal guides 9, it provides an additional sealing effect.

Furthermore, due to centrifugal force of the rotary engine 1, the lubricating oil 82 in the cavity 24, 52 will eventually adhere on the inner wall 20*b* of the stationary cylinder 2' and be drained in the oil collecting sump 81 for reuse as described above. The stationary cylinder 2', as shown in FIG. 17, is formed with two oil-draining ditches 29 around the inner wall 20*b* which are a distance h apart. Three oil draining holes 28 are opened on the section of the oil draining ditches 29 on the surface 20*a*' of the stationary cylinder 2' facing the oil collecting sump 81 and penetrate the stationary cylinder 2'. This allows the hot lubricating oil 84 on the inner wall 20*b* to flow along the oil draining ditches 29 by centrifugal force, flow downwards to the oil draining holes 28 due to gravity, and be drained to the oil collecting sump 81 for reuse.

Figure 18:
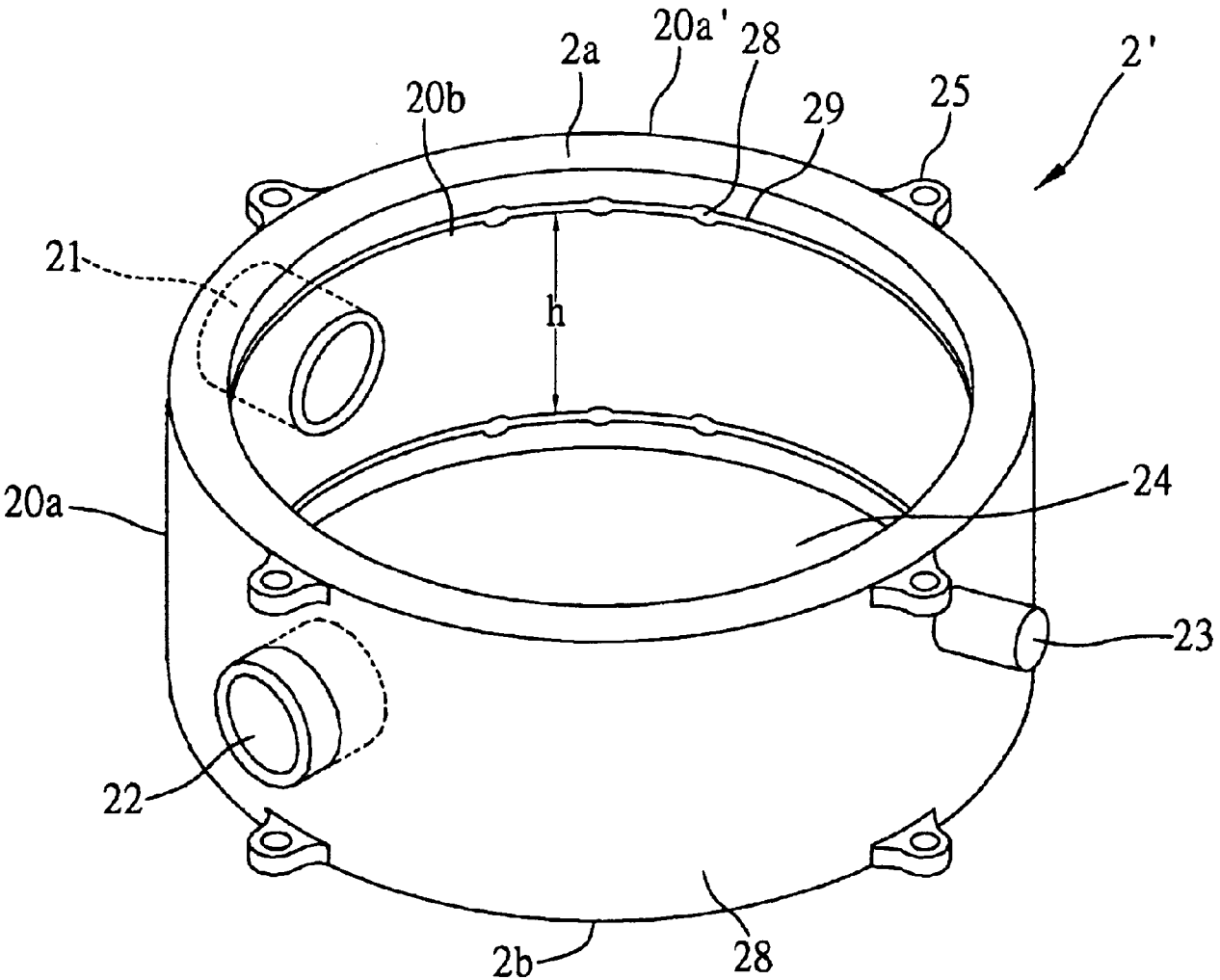
FIG. 18 is a schematic diagram of the stationary cylinder having the ability to drain lubricating oil of the twin-cylinder rotary engine according to the fourth embodiment of the present invention.
Figure 19:
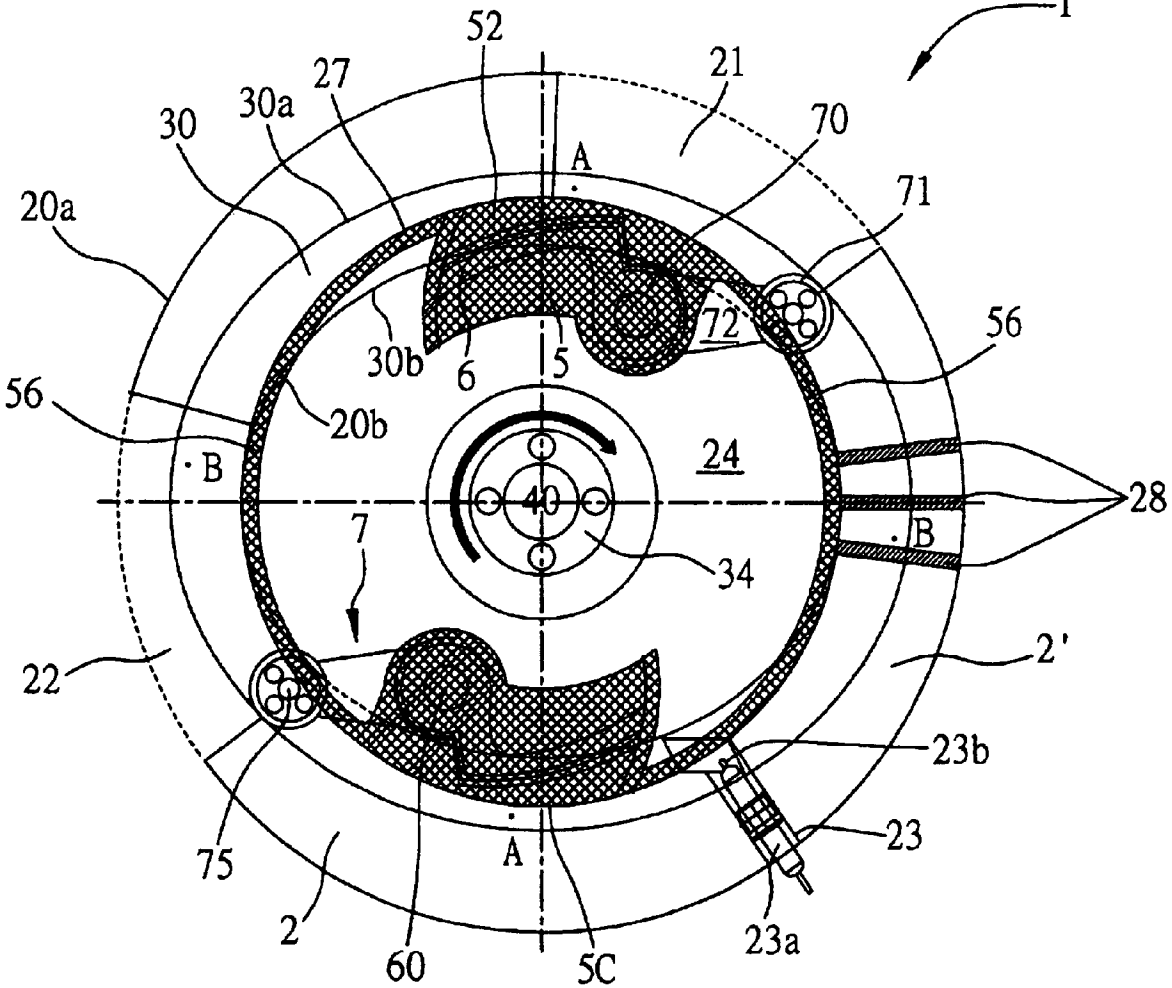
FIG. 19 is a schematic diagram of the cylinder partition of the twin-cylinder rotary engine according to the fourth embodiment of the present invention.
Figure 20:
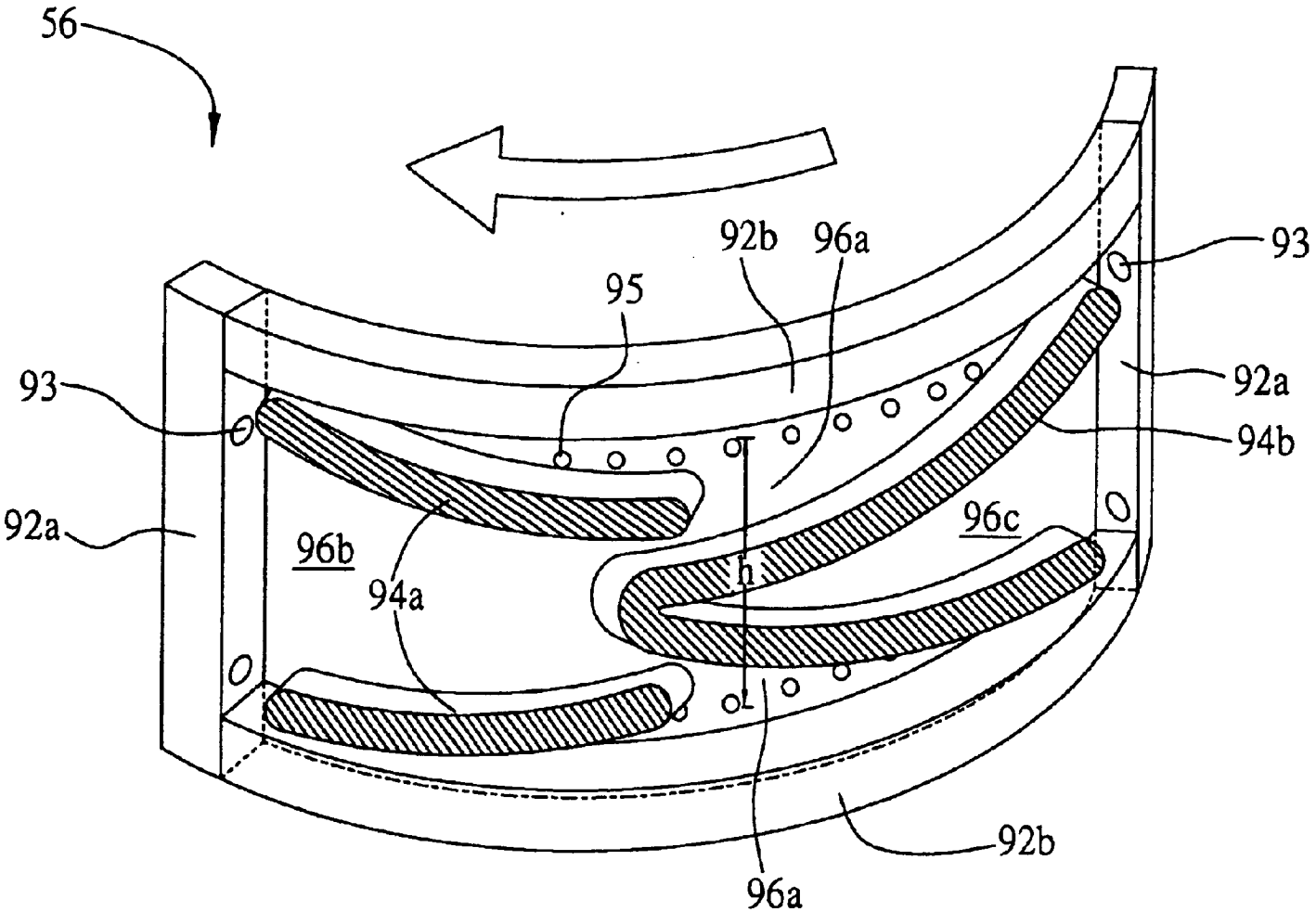
FIG. 20 is a schematic diagram of the cylinder partition according to the fourth embodiment of the present invention.

In FIG. 18, when the lubricating oil 82 is sprayed into the first cavity 24 by the first shaft 40', if the location of the rotational cylinder 5 has not covered the intake aperture 21, the exhaust aperture 22, and the ignition aperture 23, the lubricating oil 82 could flow out from the intake aperture 21, the exhaust aperture 22, and the ignition aperture 23 which might affect the ignition of the spark plug 23*a*. Therefore the fourth embodiment respectively provides two cylinder connecting partitions 56 between the two opposite rotational cylinders 5 which will cover the intake aperture 21, the exhaust aperture 22, and the ignition aperture 23 while the rotational cylinders rotate. In FIG. 19, the cylinder connecting partitions 56 are curve-shaped and are in close contact with the inner wall 20*b* of the stationary cylinder 2'. The cylinder connecting partitions 56 are driven by the driving disks 4 and accompanied with the rotation of the rotational cylinders 5. The cylinder connecting partition 56, as shown in FIG. 20 (showing only one cylinder connecting partition), has two peripheral parts 92*a*, which have connecting holes 93 for mounting to the rotational cylinders 5. At the same time, in order to improve drainage for the hot lubricating oil 84, oil-sweeping guides 94*a*, 94*b* are additionally secured on the surface of the cylinder connecting partitions 56 contacting with the inner wall 20*b* of the stationary cylinder 2'. The oil-sweeping guides 94*a* of this embodiment are two strip-type guides and a folded-type guide. The material of the oil-sweeping guides is the same as the previously mentioned seal guides 9. The thickness of the oil-sweeping guides 94 is larger than the peripheral parts 92*a*, 92*b* at the four sides of the cylinder connecting partitions 56. Thus, by the thermal expansion and the tight contact between the inner wall 20*b* of the stationary cylinder 2' and the cylinder connecting partition 56, the hot lubricating oil 84 adhered on the inner wall 20*b* of the stationary cylinder 2' will be swept off and drained. At the same time, two rolls of channeling openings 95 set apart distance-h are placed on the cylinder connecting partitions 56. The location of the channeling openings 95 corresponds to that of the oil draining ditches 29 (that are also distance-h apart) on the inner wall 20*b* of the stationary cylinder 2'. The lubricating oil 82 sprayed by the first shaft 40' is collected in the oil collecting sump 81 by the oil draining holes 28 on the oil draining ditches 29 via the channeling openings 95. The hot lubricating oil 84 that has not been collected in the oil draining ditches 29 can be swept into the upper and lower side areas 96*a* along the particular shape design of the oil-sweeping guides 94*a* and 94*b* in this embodiment. The strip-type oil-sweeping guides 94*a* sweep the hot lubricating oil 84 on the left side area 96*b* due to clockwise rotation of the cylinder connecting partition 56 for entering the upper and lower side areas 96*a*. The folded-type oil-sweeping guides 94 prevent the high temperature lubricating oil 84 from entering the right side area 96*c*, as the diagram shows. Therefore, all the hot lubricating oil 84 in the upper and lower side areas 96*a* is collected into the oil draining ditches 29 to be drained out of the stationary cylinder 2'. The aforesaid description illustrates the design of the oil-sweeping guides of this embodiment.

Figure 21:
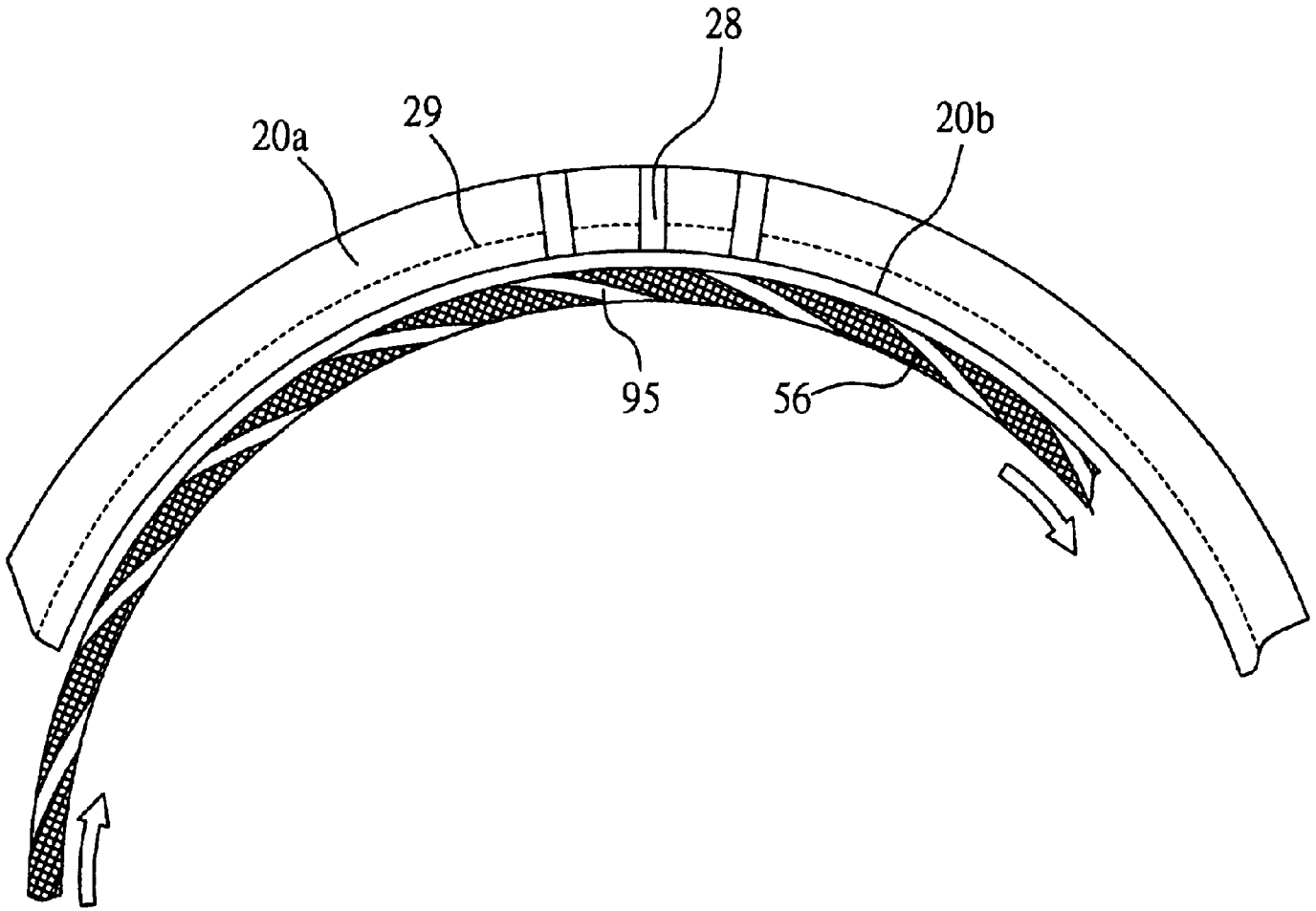
FIG. 21 is a schematic diagram of the channeling openings and oil collecting ditches according to the fourth embodiment of the present invention.

FIG. 21 shows the channeling openings 95 on the cylinder connecting partition 56 in the aforementioned paragraph. The direction of the channeling openings 95 is not perpendicular vertical to the wall of the cylinder connecting partition 56. The design is implemented so that when the cylinder connecting partition 56 follows the clockwise high rpm rotation of the rotational cylinder 5, the hot lubricating oil 84 in the channeling opening 95 will not flow back into the first cavity 24 due to centrifugal force. If the channeling openings 95 on the cylinder connecting partitions 56 are in a slanted direction, as shown in the diagram, the hot lubricating oil 84 collected into the oil draining ditches 29 won't flow back via the channeling opening 95.

Therefore, the fourth embodiment uses air-cooling (as in the first, second, and third embodiment) instead of water-cooling tanks to reduce the weight of the system and to prevent overload of the system during operation. The cooling system includes the above lubrication device 8 for providing lubricating oil 82 to cool various components of the rotary engine 1". The non-entirely sealed design of the rotary engine 1" improves the efficiency of air-cooling, such as the arc opening sections 35. on the cover plates 3 and the opening section 44 on the driving disks 4 (in FIG. 3 and 5). The heat dissipating fins on the surface 5*a*, 5*b* of the rotational cylinder 5, and the windows of the rotational cylinder 5 (both not shown) can help to improving air cooling efficiency of the first cavity 24 and the second cavity 52, so that excessive heat buildup is prevented at high rpm. At the same time, the present invention reduces friction to a minimum during operation by using a large amount of lubricating oil for lubricating the various parts. Therefore, the heat generated is much less than that of prior engines. The other components in the fourth embodiment are identical to those in the first, second, and third embodiment and, therefore, will not be further discussed.

After the manufacturing of the components mentioned in different embodiments, they can be assembled in the order below (please refer to FIG. 1):

(1) Install the seal guides 9 on the swing piston 6 and the rotational cylinders 5.

(2) Mount the swing piston 6 onto the second shaft 60 into the second cavity 52 of the rotational cylinder 5 to allow the swing piston 6 to swing, driven by the slight rotation of the second shaft 60, in the second cavity 52.

(3) Mount the rotational cylinders 5 onto the surface 4*a* of the top and bottom driving disks 4.

(4) Mount the driving disks 4 onto the first shaft 40, the first shaft 40 being firstly inserted into one hollow duct 47 for uniformly spraying lubricating oil 82.

(5) Then, install the driving wheel assembly 7, wherein the driven wheel set 70 is secured to the second shaft 60 that exposes from the second surface 4*b* of the driving disks 4.

(6) Assemble the driving disks 4, the driving wheel assembly 7, and the rotational cylinders 5 (including the swing piston 6) into the stationary cylinder 2.

(7) Install the top and bottom cover plates 3 to seal the stationary cylinder 2 and mount the driving wheel assembly 7 on the second surface 4*b* of the top and bottom driving disks 4 so the leading wheel set 71 of the driving wheel assembly 7 is placed in the elliptic track 30 on the surface 3*a* of the cover plate 3.

(8) Install the spark plug 23*a* into the ignition aperture 23 on the outer wall 20*a* of the stationary cylinder 2.

(9) Finally, mount the external starting motor and the lubrication device to the engine system by the first shaft 40 exposing out of the second surface 3*b* of the cover plates 3 to complete the assembly process of the rotary engine 1.

Summarizing the description of the four embodiments, the rotary engine 1 of the present invention improves over the disadvantages of the conventional reciprocating and Wankel engines to increase performance as detailed below:

(1) Improved output efficiency: the combustion force from the spark plugs directly pushes the rotational cylinder and then transfers the power to the driving disks and the first shaft, where the output efficiency is significantly higher than the reciprocating engine which requires a translation of motion type. The driving disk of the present invention is much smoother in operation than the triangular rotor of Wankel engine. Friction during operation of the present invention is much less than that of the Wankel engine. And compared with Wankel engine, the opening direction of the ignition aperture of the present invention is closer to the peripherally tangential direction of the driving disks. So, the power from combustion of the present invention is much higher than that of the Wankel engine.

(2) Simpler structure and manufacture: the components of the present invention are less complex than those of a reciprocating engine. In comparison with Wankel engine, the driving disks of the present invention do not require high precision gear driving and guiding. The rotational cylinders and the swing piston of the present invention rotate in a circular orbit and the leading wheel set of the driving system rotates along an elliptic track. This kind of combination of design is much simpler than the one of the triangular rotor and special rotation track of the Wankel engine. This simplicity helps to broaden the applicability of the present invention in industry. In addition to the high friction and high fuel consumption drawbacks, complexity in manufacturing and capital equipment investment are also important factors hindering the development and acceptance of the Wankel engine. All of the aforesaid problems caused most of the existing reciprocating manufacturers to not want to take the risk of changing their entire production lines. However, the present invention is structurally simple and easier to manufacture, and the production line and equipment is easier to set up, so the present invention solves all the problems with practicality of the Wankel engine.

(3) Increased torque without increased fuel consumption: when the length of the crankshaft arm of a reciprocating engine or the size of the rotor of the Wankel engine are increased, the torque of each engine increases as well. However, such an increase causes the engine size and the intake/exhaust volume to increase and therefore increases fuel consumption. With the design of the present invention, if the designer wishes to increase the diameter of the driving disks to increase the torque, the second cavity of the rotational cylinder can remain the same and therefore does not increase the fuel consumption.

Figure 22:
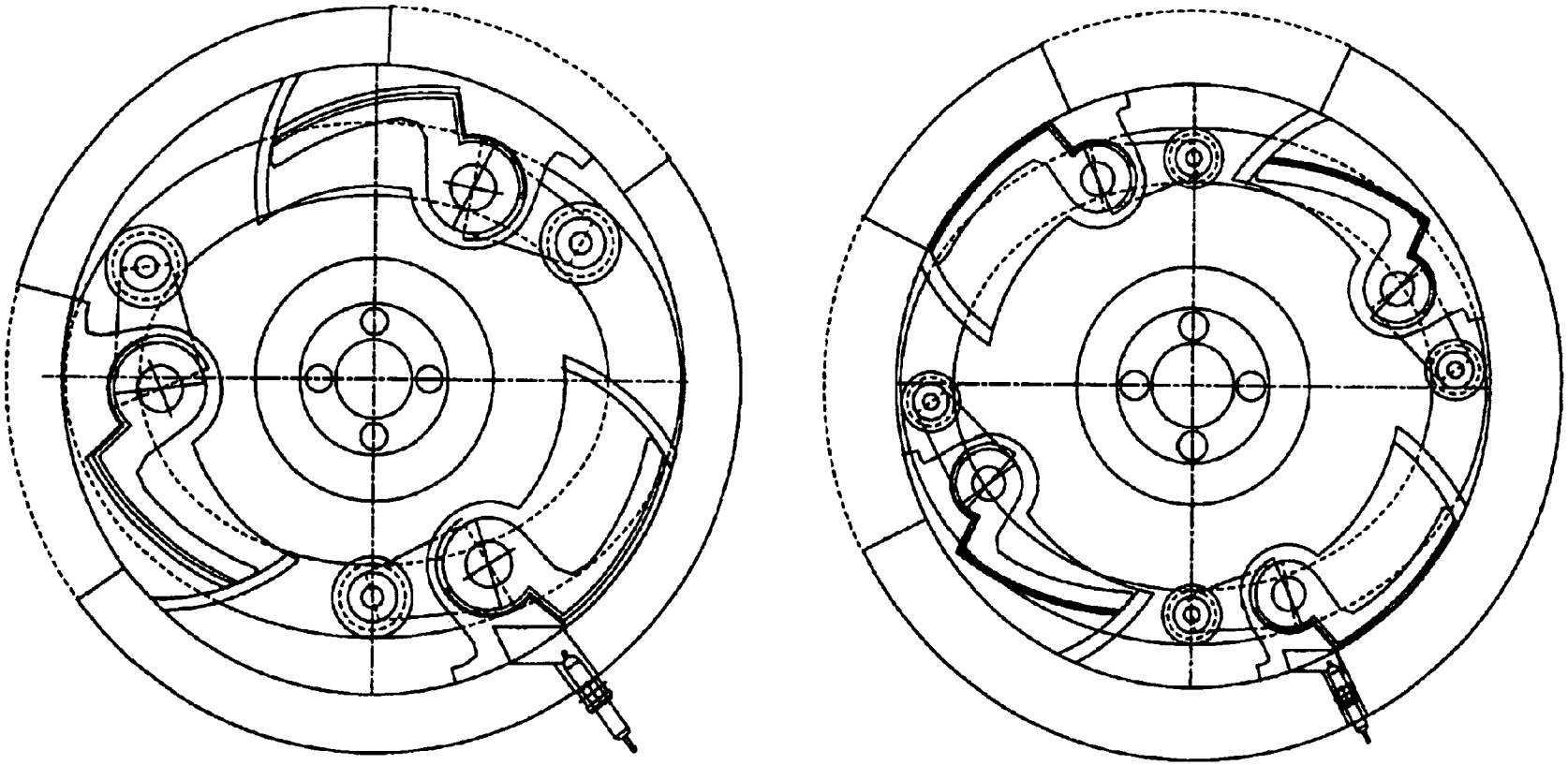
FIG. 22 is a schematic diagram showing the increase of rotational cylinders within the stationary cylinder.
Figure 23:
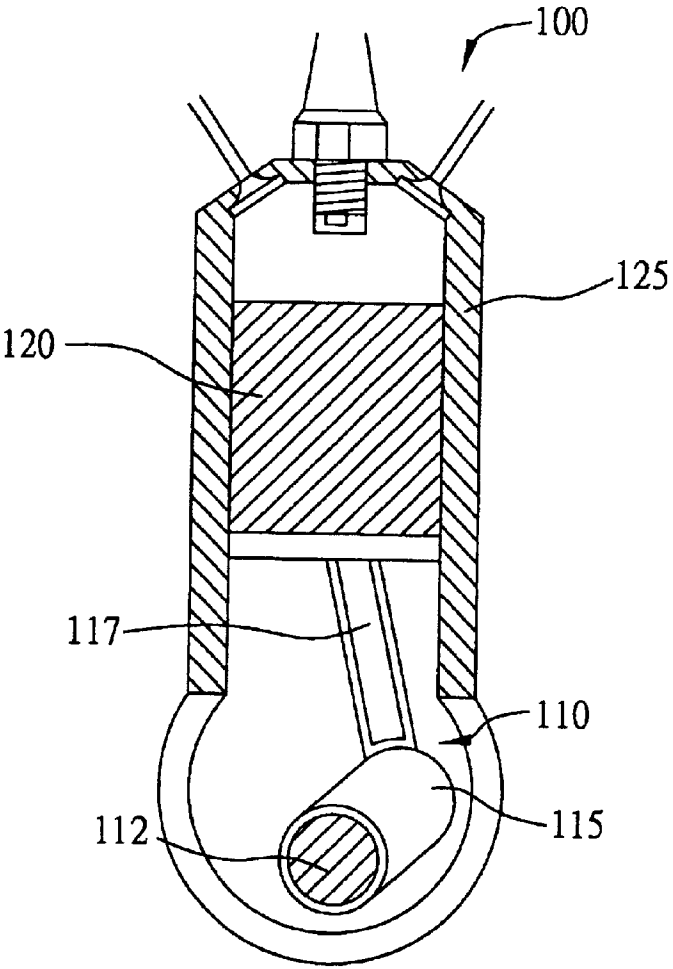
FIG. 23 (PRIOR ART)
FIG. 23 is a schematic diagram of a conventional reciprocating engine.
Figure 24:
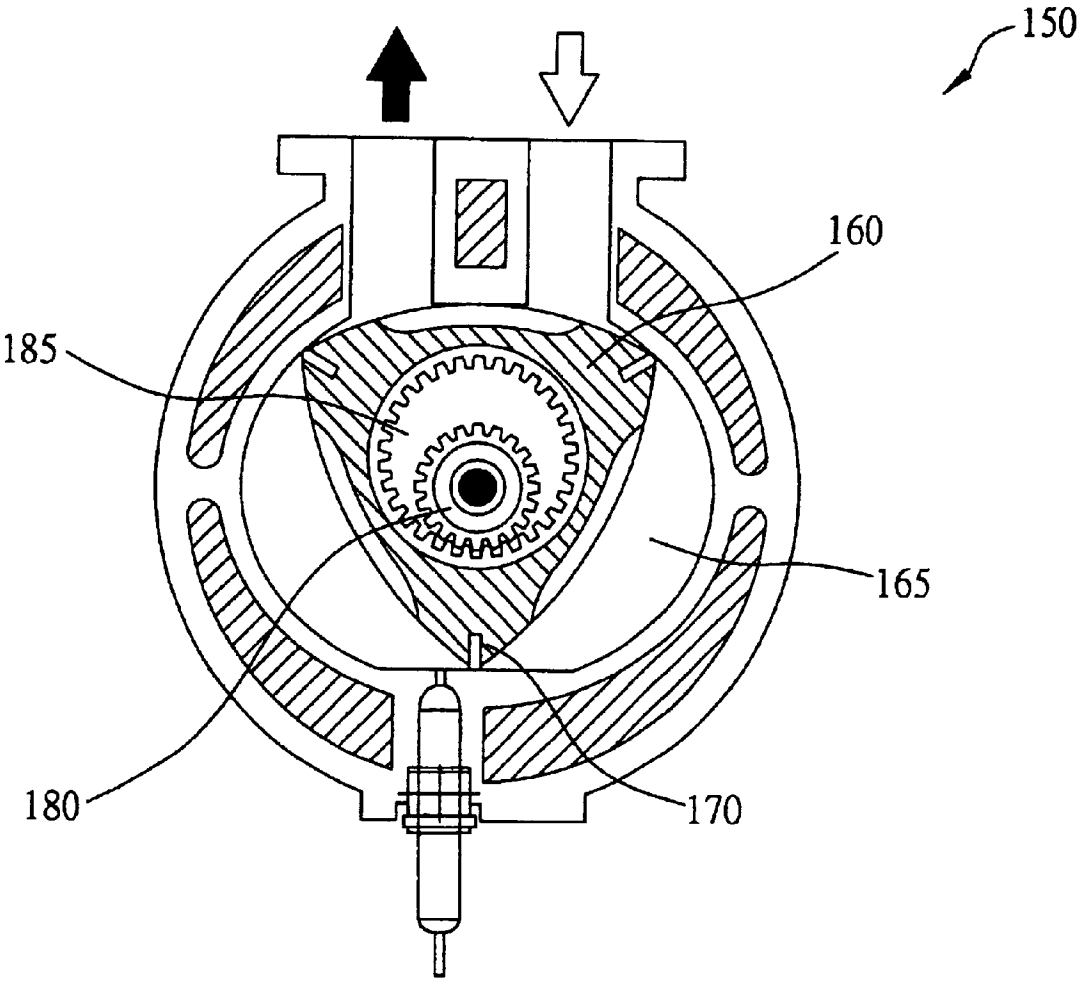
FIG. 24 (PRIOR ART)
FIG. 24 is a schematic diagram of a conventional Wankel rotary engine.

(4) The number of cylinders can be flexibly changed: increasing the horsepower of a reciprocating engine or Wankel engine usually involved using a V or W shape arrangement to double or triple the number of cylinders. This method significantly increases the volume occupied by the engine and, furthermore, the usage of material. In FIG. 22, the present invention only needs to (1) increase the number of rotational cylinders within the stationary cylinder to change the number of cylinders (the diagrams respectively add up to 3 and 4 cylinders for example) or (2) change the number of stationary cylinders without changing the number of rotational cylinders inside a stationary cylinder and change the phase difference between the stationary cylinders to synchronize combustion at different timing to achieve the same output. The decision of the assembly configuration depends on the size of the rotational cylinder and the stationary cylinder. For example, in designing a six-cylinder engine, one can put all six rotational cylinders into one stationary cylinder; or put three rotational cylinders into two stationary cylinders (with ignition locations 180 degrees apart); or put two rotational cylinders into three stationary cylinders (with ignition locations 120 degrees apart) and the like according to the desired system volume and manufacturing cost.

(5) Reduced friction during operation: various parts of the present invention have undergone special design considerations to reduce friction to a minimum. For example, the swing piston secured on the second shaft does not generate friction as it swings; the radius of the driving disks is smaller than that of the stationary cylinder; the cross-section area of the first shaft is smaller than that of the opening on the cover plate and the cross-section area of the second shaft is smaller than that of the openings of the driving disks; and the design of the leading wheel set (big and small wheel) of the driving wheel assembly minimizes friction. All of the above prevent friction between components. Therefore, during rotation of the rotary engine of the present invention, only the bearing and the seal guides mounted on the rotational cylinders and the swing piston experience friction. The movement of the driving disk 4 is in a smooth circular motion to reduce friction with the seal guides on the rotational cylinders. Therefore, friction from the seal guides on the rotational cylinders of this invention is much less than that of the three triangular tips of the triangular rotor of the Wankel engine.

(6) Superior sealing effect: a plurality of seal guides are located on the rotational cylinders and the swing piston for sealing the gap between the rotational cylinder and the stationary cylinder, and the gap between the swing piston and the rotational cylinders. Thermal expansion of the seal guides further enhances the sealing effect, wherein heating comes from the high rpm rotation. Therefore, gas leakage during the intake/exhaust process is prevented. Furthermore, the lubricating oil sprayed by the lubrication device surrounds the seal guides and improves the sealing effect.

(7) Lower cost and easier lubrication: the present invention take advantages of existing motion to implement lubrication. The spraying of the lubricating oil is achieved by centrifugal force from the high-rpm rotation of the first shaft that is the original power source of the engine (coupled to an external starting motor), without the addition of extra driving equipment for the lubrication device, reducing the cost and the weight of the system. At the same time, the openings on the surface of the hollow duct on the first shaft help to uniformly distribute the lubricating oil and maximize the lubrication effect. Furthermore, the oil draining holes on the outer wall of the stationary cylinder, the oil collecting sump of the lubrication device, the pump, and the heat dissipating fins all help to facilitate recycling of the hot lubricating oil. Together, they comprise a system that reduces cost and the weight of the lubrication device to a minimum so that the lubrication device does not add unnecessary load to the engine.

(8) Easier and low cost cooling: the addition of heat dissipating fins on the rotational cylinders and the non-sealed design of the system improves air-cooling efficiency. The oil draining holes on the stationary cylinder, the arc opening sections on the cover plates, the opening sections on the driving disks, and the windows on the rotational cylinders all contribute to the elimination of the need for a water tank and other water cooling equipment. The lubricating oil sprayed by the lubrication device helps heat exchange from various components without the need of extra space and weight from any redundant lubrication device. This saving of space and weight lowers manufacturing cost.

Summarizing the above, the rotary engine of the present invention is an entirely new concept. The design of each engine component is not limited to what is disclosed but can be broadly interpreted under the scope of the claims. For example, the driving source to drive the rotational cylinder in the stationary cylinder can be any kind of rotational members and is not limited to the rotational cylinder being driven by the first shaft and driving disks of the aforementioned embodiments. At the same time, the driving source for the swing piston to swing in the rotational cylinder can be of any kind and is not limited to the aforementioned driving wheel assembly. The spark plug combustion can be replaced by diesel injection to facilitate a diesel engine. The swing piston can be of any shape. There is no restriction on the type of fuel, which can be petroleum, diesel, natural gas, hydrogen, and the like that is suitable for the present invention. Furthermore the present invention can be applied to any type of transportation, or any device that needs power such as generators, agricultural machinery, industrial machinery, and the like.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A rotary engine, comprising:

a stationary cylinder internally comprising a first cavity, wherein an intake aperture and an exhaust aperture are located on a surface of the stationary cylinder for providing gas intake and exhaust in and out of the first cavity, and an ignition aperture is located on the surface of the stationary cylinder for providing combustion;

a rotational member coupled to an external drive source for generating rotation;

at least one rotational cylinder, having a second cavity and driven by the rotation of the rotational member, rotating inside the first cavity and sequentially passing by the intake aperture, the ignition aperture, and the exhaust aperture on the surface of the stationary cylinder, wherein the rotational cylinder also has a window on a surface for providing a channel to the intake aperture, the ignition aperture, and the exhaust aperture when the rotational cylinder rotates and passes by those apertures;

at least one swing piston corresponding to the rotational cylinder, placed in the second cavity and swinging within the second cavity for altering the volume of the intake/exhaust space of the second cavity to define the second cavity as a volume-variable intake/exhaust space; and at least one driving member corresponding to the rotational cylinder driving the swing piston to swing within the second cavity of the rotational cylinder to match the position of the rotational cylinder during rotation.

2. The rotary engine in claim 1, wherein the rotational member is a driving disk coupled to a first shaft that is placed at the center of the stationary cylinder where the first shaft exposes from the stationary cylinder for coupling to the external driving source.

3. The rotary engine in claim 2, wherein the number of driving disks is two and the two driving disks are correspondingly coupled to the opposite side of the top and bottom part of the first cavity and the rotational cylinders are secured between the two driving disks.

4. The rotary engine in claim 3, wherein each rotational cylinder forms a group with one swing piston and two driving members that correspond to the top and bottom driving disks.

5. The rotary engine in claim 1, wherein the swing piston swings corresponding to the rotational position of the rotational cylinder, the intake/exhaust volume gradually increases as the rotational cylinder passes by the intake aperture, then the intake/exhaust volume gradually decreases as the rotational cylinder passes by the ignition aperture, and finally the intake/exhaust volume first gradually increases and then gradually decreases as the rotational cylinder passes by the exhaust aperture.

6. The rotary engine in claim 1, wherein a swing piston is secured to a second shaft that is inserted in the corresponding rotational cylinder and the second shaft is coupled to the driving members that drive the swing piston to swing in the second cavity.

7. The rotary engine in claim 1, wherein the driving member is a driving wheel assembly comprising a leading wheel set, a driven wheel set, and a connecting arm that couples the leading wheel set and the driven wheel set.

8. The rotary engine in claim 7, wherein the driven wheel set is coupled to the rotational cylinder for rotating in a circular orbit driven by the rotational member.

9. The rotary engine in claim 7, wherein an inner surface of the stationary cylinder comprises a closed non-circular track for accommodating the leading wheel set of the driving wheel assembly in the non-circular track and the leading wheel set rotates in the non-circular track driven by the rotational member.

10. The rotary engine in claim 9, wherein the closed non-circular track is an elliptic track.

11. The rotary engine in claim 7, wherein the stationary cylinder comprises a cover plate parallel to the inner surface of the stationary cylinder, the cover plate further comprising a non-circular track on the surface for accommodating the leading wheel set of the driving wheel assembly in the non-circular track and the leading wheel set rotates in the non-circular track driven by the rotational member.

12. The rotary engine in claim 10, wherein the closed non-circular track is an elliptic track.

13. The rotary engine in claim 7, wherein the leading wheel set is a set of a first wheel and a second wheel, where both wheels rotate about the same axle, the first wheel. being in contact only with an outer surface of the non-circular track and the second wheel being in contact only with an inner surface of the non-circular track when the leading wheel set rotates in the non-circular track.

14. The rotary engine in claim 7, wherein the leading wheel set is an elongated cylinder.

15. The rotary engine in claim 1, wherein a surface of the rotational cylinder and a surface of the swing piston further comprise a plurality of seal guides for closing gaps among the swing piston, the rotational cylinder, and the stationary cylinder by thermal expansion of the seal guides to prevent gas leakage.

16. A rotary engine, comprising:

a stationary cylinder internally comprising a first cavity, wherein an intake aperture and an exhaust aperture are placed on a surface of the stationary cylinder for providing gas intake and exhaust in and out of the first cavity, an ignition aperture is placed on the surface of the stationary cylinder for providing combustion, and a closed non-circular track is placed on an inner surface of the stationary cylinder;

a first shaft, inserted in the stationary cylinder and exposed from the stationary cylinder for coupling to an external drive source;

a driving disk, coupled to the first shaft and accommodated in the first cavity, rotating within the first cavity and driven by the drive source;

at least one rotational cylinder, having a second cavity, coupled to a surface of the driving disk rotating within the first cavity about the first shaft driven by the driving disk, wherein a window is placed on a surface of the rotational cylinder for providing a channel to the intake aperture, the ignition aperture, and the exhaust aperture of the stationary cylinder when the rotational cylinder rotates and passes by those apertures;

at least one swing piston corresponding to the rotational cylinder, placed in the second cavity, coupled to a second shaft, and driven by the deflective rotation of the second shaft, swinging within the second cavity for altering the volume of the intake/exhaust space in the second cavity to define the second cavity as a volume-variable intake/exhaust space; and at least one driving wheel assembly corresponding to the rotational cylinder comprising a interconnected leading wheel set and driven wheel set, wherein the driven wheel set is coupled to the second shaft exposed from the driving disk and driven by the rotation of the driving disk to rotate in a circular orbit about the first shaft, the leading wheel set being accommodated and rotating inside the closed non-circular track on the inner surface of the stationary cylinder to drive the second shaft that is coupled to the driven wheel set to defectively rotate within the second cavity for driving the swing piston to swing within the second cavity of the rotational cylinder to match the position of the rotational cylinder during rotation.

17. The rotary engine in claim 16, wherein the number of driving disks is two and the two driving disks are correspondingly coupled to the opposite sides of the top and bottom parts of the first cavity and the rotational cylinders are secured between the two driving disks.

18. The rotary engine in claim 17, wherein each rotational cylinder forms a group with one swing piston and two driving wheel assemblies that correspond to the top and bottom driving disks.

19. The rotary engine in claim 16, wherein the swing piston swings corresponding to the position of the rotational cylinder during rotation, the intake/exhaust volume gradually increases as the rotational cylinder passes by the intake aperture, the intake/exhaust volume gradually decreases as the rotational cylinder passes by the ignition aperture, and the intake/exhaust volume first gradually increases then gradually decreases as the rotational cylinder passes by the exhaust aperture.

20. The rotary engine in claim 16, wherein the stationary cylinder has a cover plate parallel to the driving disk for sealing the stationary cylinder in which the cover plate has the closed non-circular track located on a surface of the cover plate.

21. The rotary engine in claim 16, wherein the leading wheel set comprises a first wheel and a second wheel, where both wheels rotate about the same axle, the first wheel being in contact only with an outer surface of the non-circular track and the second wheel being in contact only with the inner surface of the non-circular track when the leading wheel set rotates in the non-circular track.

22. The rotary engine in claim 16, wherein the leading wheel set is an elongated cylinder.

23. The rotary engine in claim 16, wherein the closed non-circular track is an elliptic track.

24. A rotary engine comprising:

a stationary cylinder internally comprising a first cavity, wherein an intake aperture and an exhaust aperture are placed on a surface of the stationary cylinder for providing gas intake and exhaust in and out of the first cavity and an ignition aperture is placed on the surface of the stationary cylinder for providing combustion;

a first shaft inserted in the stationary cylinder exposed from the stationary cylinder for coupling to an external drive source, wherein at least one trench is provided on the surface of the first shaft;

a driving disk that is coupled to the first shaft and accommodated in the first cavity and rotating within the first cavity driven by the drive source;

at least one rotational cylinder, having a second cavity, rotating within the first cavity about the first shaft driven by the driving disk, wherein a window is placed on a surface of the rotational cylinder for providing a channel to the intake aperture, the ignition aperture, and the exhaust aperture of the stationary cylinder when the rotational cylinder rotates and passes by those apertures;

at least one swing piston corresponding to the rotational cylinder, placed in the second cavity, swinging within the second cavity for altering the volume of the intake/exhaust space of the second cavity to define the second cavity as a volume-variable intake/exhaust space;

at least one driving member corresponding to the rotational cylinder for driving the swing piston to swing within the second cavity of the rotational cylinder to match the position of the rotational cylinder during rotation; and a lubrication device comprising at least an oil tank coupled to the first shaft, wherein centrifugal force, created by the rotation of the first shaft, sprays the lubricating oil from the oil tank along said at least one trench placed on the surface of the first shaft, into the stationary cylinder for lubrication.

25. The rotary engine in claim 24, wherein the lubrication device comprises a lubrication oil collecting sump that is coupled to the stationary cylinder for draining the lubricating oil in the stationary cylinder to the lubrication oil collecting sump.

26. The rotary engine in claim 25, wherein the lubricating oil in the stationary cylinder is drained via oil draining holes on the surface of the stationary cylinder to the lubrication oil collecting sump.

27. The rotary engine in claim 25, wherein the lubrication oil collecting sump comprises a pump for pumping the lubricating oil in the lubrication oil collecting sump back to the oil tank that is coupled to the first shaft.

28. The rotary engine in claim 25, wherein the oil tank comprises a heat dissipating unit for cooling the lubricating oil from the lubrication oil collecting sump so that the lubricating oil may be reused after heat exchange.

29. The rotary engine in claim 25, wherein the rotational cylinders placed in the stationary cylinder are coupled to cylinder connecting partitions that rotate synchronously with the rotational cylinders for preventing lubricating oil which is in the stationary cylinder and sprayed from the first shaft, from entering the intake aperture, the exhaust aperture, and the ignition aperture, and wherein at least one oil-sweeping guide is located on the cylinder connecting partitions to increase the speed of draining the lubricating oil to the lubrication oil collecting sump.

* * * * *